US008359954B2

(12) United States Patent
Johnson et al.

(10) Patent No.: US 8,359,954 B2
(45) Date of Patent: Jan. 29, 2013

(54) RADIAL FOLDOUT TOOL WITH MULTIPLE TYPES OF TOOLS AND BIT STORAGE

(75) Inventors: Ronald L. Johnson, San Jose, CA (US); Robert J. Gallegos, Fremont, CA (US); Steven Simas Escobar, San Jose, CA (US); Idriss Mansouri-Chafik Ruiz, San Jose, CA (US); Yugen Patrick Lockhart, Palo Alto, CA (US)

(73) Assignee: Wagic, Inc., Los Gatos, CA (US)

( * ) Notice: Subject to any disclaimer, the term of this patent is extended or adjusted under 35 U.S.C. 154(b) by 420 days.

(21) Appl. No.: 12/567,569

(22) Filed: Sep. 25, 2009

(65) Prior Publication Data

US 2011/0000024 A1 Jan. 6, 2011

Related U.S. Application Data

(63) Continuation-in-part of application No. 12/009,461, filed on Jan. 17, 2008.

(51) Int. Cl.

| | |
|---|---|
| ***B25B 13/00*** | (2006.01) |
| ***B25B 23/00*** | (2006.01) |
| ***B25G 1/08*** | (2006.01) |
| ***B25F 1/00*** | (2006.01) |
| ***B25F 1/02*** | (2006.01) |
| ***B25F 1/04*** | (2006.01) |
| ***B65D 85/28*** | (2006.01) |

(52) U.S. Cl. ..... 81/440; 81/124.4; 81/177.4; 81/490; 81/437; 81/438; 81/439; 81/124.5; 81/177.6; 81/489; 7/167; 7/168; D8/85; 206/373; 206/374; 206/375; 206/376; 206/377; 206/378; 206/379

(58) Field of Classification Search ..... 81/124.4, 81/177.4, 490, 440, 437–439, 124.5, 177.6, 81/489; 7/167, 168; D8/85; 206/373–379
See application file for complete search history.

(56) References Cited

U.S. PATENT DOCUMENTS

| | | | | |
|---|---|---|---|---|
| 244,309 | A | 7/1881 | Rhodes | |
| 363,331 | A * | 5/1887 | Hammer | 7/138 |
| 364,422 | A | 6/1887 | Laforge | |
| 580,235 | A | 4/1897 | Strum | |
| 647,528 | A | 4/1900 | Schmidt | |
| 763,745 | A | 6/1904 | Gheen | |
| 873,363 | A | 12/1907 | Ross | |
| 875,493 | A | 12/1907 | Beard | |

(Continued)

FOREIGN PATENT DOCUMENTS

| | | |
|---|---|---|
| CA | 1 147 176 | 5/1983 |
| JP | 57-13165 | 1/1982 |

(Continued)

*Primary Examiner* — Monica Carter
*Assistant Examiner* — Danny Hong
(74) *Attorney, Agent, or Firm* — Haverstock & Owens LLP

(57) ABSTRACT

A device includes a body having a first end, a second end, and four faces. The device is configured to stand upright on the second end. A plurality of tools is stored against the four faces in a closed position. A first face and a second face each includes a bit storage that holds at least one socket. A third face includes a drive, a can opener, and a blade. The drive and the can opener rotate about a first rotatable mechanism coupled to the second end. The blade rotates about an insert coupled to the first end. A fourth face includes a first set of tool drivers that rotates about a second rotatable mechanism coupled to the second end and a second set of tool drivers that rotates about a third rotatable mechanism coupled to the first end.

29 Claims, 17 Drawing Sheets

U.S. PATENT DOCUMENTS

| | | | | |
|---|---|---|---|---|
| 959,408 | A | | 5/1910 | Volbert |
| 1,000,900 | A | | 8/1911 | Dorsey |
| 1,006,679 | A | | 10/1911 | Rice |
| 1,100,070 | A | | 6/1914 | Graham |
| 1,172,656 | A | | 2/1916 | Yorgensen |
| 1,187,842 | A | | 6/1916 | Kaas |
| D53,597 | S | * | 7/1919 | Marcmann ..... D8/28 |
| 1,337,769 | A | | 4/1920 | Hemming |
| 1,398,583 | A | | 11/1921 | Bovee |
| 1,425,270 | A | | 8/1922 | Morgan |
| 1,500,852 | A | | 7/1924 | Shepard |
| 1,502,044 | A | | 7/1924 | McCann |
| 1,530,905 | A | | 3/1925 | Nance |
| 1,559,097 | A | | 10/1925 | Hill |
| 1,753,026 | A | | 4/1930 | Rosati |
| 1,825,936 | A | | 10/1931 | Bodmer |
| 1,888,222 | A | | 11/1932 | Curtis et al. |
| 1,915,245 | A | | 6/1933 | Cook |
| 1,944,606 | A | | 1/1934 | Little |
| 1,970,409 | A | | 8/1934 | Wiedemann |
| 2,236,333 | A | | 3/1941 | Cowles |
| 2,332,656 | A | | 10/1943 | Mirando |
| 2,346,364 | A | | 4/1944 | Dowe |
| D142,982 | S | | 11/1945 | Bloomfield |
| 2,409,613 | A | | 10/1946 | Brooks |
| 2,410,971 | A | | 11/1946 | Hartley |
| 2,465,619 | A | | 3/1949 | Veit |
| 2,475,268 | A | | 7/1949 | Wittle |
| 2,485,991 | A | | 10/1949 | Stowell |
| D156,677 | S | | 12/1949 | Smith |
| D157,154 | S | | 2/1950 | Horton |
| 2,509,507 | A | | 5/1950 | Kane |
| 2,512,967 | A | | 6/1950 | Quiron |
| 2,530,024 | A | | 11/1950 | Moody |
| 2,532,636 | A | | 12/1950 | Minnich |
| 2,569,069 | A | | 9/1951 | Motel |
| 2,590,307 | A | | 3/1952 | Gibson |
| 2,593,828 | A | | 4/1952 | Arey |
| 2,604,211 | A | | 7/1952 | Steine |
| 2,701,052 | A | | 2/1955 | Martel |
| D175,056 | S | | 6/1955 | Wilson |
| 2,715,028 | A | | 8/1955 | Dossie |
| 2,719,042 | A | | 9/1955 | Epsy |
| 2,776,589 | A | * | 1/1957 | Gregory ..... 81/177.4 |
| 2,778,396 | A | | 1/1957 | Swain |
| D179,979 | S | | 4/1957 | Noga |
| 2,800,816 | A | | 7/1957 | Tasciotti |
| 2,804,970 | A | | 9/1957 | Kuc et al. |
| 2,810,472 | A | | 10/1957 | Midkiff |
| 2,836,210 | A | | 5/1958 | Garofalo |
| 2,842,020 | A | | 7/1958 | Tarquinio |
| 2,844,244 | A | | 7/1958 | Hanson |
| 2,854,741 | A | | 10/1958 | Chogler |
| 2,878,701 | A | | 3/1959 | Weersma |
| 3,023,054 | A | | 6/1960 | Shigekuni |
| 3,061,927 | A | | 11/1962 | Von Frankenberg et al. |
| 3,113,479 | A | | 12/1963 | Swingle |
| 3,156,143 | A | | 11/1964 | Wolf |
| 3,222,959 | A | | 12/1965 | Clark |
| 3,255,792 | A | | 6/1966 | Beck |
| 3,257,991 | A | | 6/1966 | Mosch |
| D205,745 | S | | 9/1966 | Nannfeldt |
| 3,342,229 | A | | 9/1967 | Janes |
| 3,343,434 | A | | 9/1967 | Schroeder |
| 3,424,039 | A | | 1/1969 | Scott |
| 3,592,086 | A | | 7/1971 | Derwin |
| 3,654,975 | A | | 4/1972 | Ballsmith et al. |
| 3,667,518 | A | | 6/1972 | Stillwagon, Jr. |
| 3,802,286 | A | | 4/1974 | Winklhofer et al. |
| 3,863,693 | A | | 2/1975 | Carriker |
| 3,943,801 | A | | 3/1976 | Yates |
| 3,958,469 | A | | 5/1976 | Meese |
| 3,997,053 | A | | 12/1976 | Bondhus |
| 4,000,767 | A | | 1/1977 | Geng |
| 4,043,230 | A | | 8/1977 | Scrivens |
| 4,154,125 | A | | 5/1979 | Frank |
| 4,196,761 | A | | 4/1980 | Royer |
| 4,227,430 | A | | 10/1980 | Jansson et al. |
| 4,235,269 | A | | 11/1980 | Kraus |
| 4,238,862 | A | | 12/1980 | Leatherman |
| 4,241,773 | A | | 12/1980 | Personnat |
| 4,302,990 | A | | 12/1981 | Chrichton et al. |
| 4,308,770 | A | | 1/1982 | MacDonald |
| 4,327,790 | A | | 5/1982 | Stevens et al. |
| 4,384,499 | A | | 5/1983 | Shockley |
| D270,024 | S | | 8/1983 | Chan |
| 4,424,728 | A | | 1/1984 | MacDonald |
| 4,448,097 | A | | 5/1984 | Rocca |
| 4,469,109 | A | | 9/1984 | Mehl |
| 4,476,751 | A | | 10/1984 | Mishima |
| 4,525,889 | A | | 7/1985 | Dunau |
| 4,542,667 | A | | 9/1985 | Jang |
| 4,699,020 | A | | 10/1987 | Bush et al. |
| 4,703,673 | A | | 11/1987 | Allen |
| 4,711,353 | A | | 12/1987 | Rozmestor |
| 4,716,795 | A | | 1/1988 | Corona et al. |
| 4,716,796 | A | | 1/1988 | Corona et al. |
| 4,767,006 | A | | 8/1988 | Wasem |
| 4,783,867 | A | | 11/1988 | Tsao |
| 4,787,276 | A | | 11/1988 | Condon |
| 4,815,346 | A | | 3/1989 | Littlehorn |
| 4,819,523 | A | | 4/1989 | Souza |
| 4,819,800 | A | | 4/1989 | Wilson |
| 4,820,090 | A | | 4/1989 | Chen |
| D302,102 | S | | 7/1989 | Amagaya |
| 4,882,841 | A | | 11/1989 | Margolis |
| 4,926,721 | A | | 5/1990 | Hsia |
| D308,462 | S | | 6/1990 | Komatsu |
| 4,934,223 | A | | 6/1990 | Wong |
| D310,770 | S | | 9/1990 | Zamarripa |
| D311,124 | S | * | 10/1990 | Learney ..... D8/105 |
| 4,960,016 | A | | 10/1990 | Seals |
| 4,974,477 | A | | 12/1990 | Anderson |
| 4,979,407 | A | | 12/1990 | Hernandez et al. |
| 5,029,707 | A | | 7/1991 | Feng |
| 5,036,975 | A | | 8/1991 | Chow |
| 5,062,173 | A | | 11/1991 | Collins et al. |
| 5,063,796 | A | | 11/1991 | Gennep |
| 5,065,487 | A | | 11/1991 | Yother |
| 5,086,674 | A | * | 2/1992 | Her ..... 81/124.4 |
| 5,146,815 | A | | 9/1992 | Scott, III |
| 5,147,038 | A | | 9/1992 | Pergeau |
| D333,769 | S | | 3/1993 | Jureckson |
| D334,516 | S | | 4/1993 | Tsunoda |
| D339,048 | S | | 9/1993 | Baum |
| 5,263,389 | A | | 11/1993 | Frazzell et al. |
| 5,265,504 | A | | 11/1993 | Fruhn |
| D342,433 | S | | 12/1993 | Sorenson |
| 5,271,300 | A | | 12/1993 | Zurbuchen et al. |
| D343,106 | S | | 1/1994 | Eklind et al. |
| 5,295,422 | A | | 3/1994 | Chow |
| 5,320,004 | A | | 6/1994 | Hsiao |
| 5,329,834 | A | | 7/1994 | Wong |
| 5,394,984 | A | | 3/1995 | Aiba |
| D359,671 | S | | 6/1995 | Acosta |
| 5,450,774 | A | | 9/1995 | Chang |
| 5,450,775 | A | | 9/1995 | Kozak |
| 5,461,950 | A | | 10/1995 | Iwinski |
| D365,681 | S | | 1/1996 | Chow |
| 5,480,166 | A | | 1/1996 | Milsop |
| 5,495,942 | A | | 3/1996 | Izhak |
| 5,499,560 | A | | 3/1996 | Aeschliman |
| 5,499,562 | A | | 3/1996 | Feng |
| 5,517,885 | A | | 5/1996 | Feng |
| 5,522,291 | A | * | 6/1996 | Liu ..... 81/490 |
| 5,535,882 | A | | 7/1996 | Liu |
| D373,943 | S | | 9/1996 | Fuhrmann |
| 5,553,340 | A | | 9/1996 | Brown, Jr. |
| 5,566,596 | A | | 10/1996 | Lin |
| D376,520 | S | | 12/1996 | Morin |
| 5,581,834 | A | | 12/1996 | Collins |
| D377,444 | S | | 1/1997 | Lin |
| 5,592,859 | A | | 1/1997 | Johnson et al. |
| D378,797 | S | | 4/1997 | Poremba et al. |
| D380,131 | S | | 6/1997 | Sung |
| D382,190 | S | | 8/1997 | Blackston et al. |
| 5,653,525 | A | | 8/1997 | Park |

D383,048 S 9/1997 Sorensen et al.
5,662,013 A 9/1997 Lin
D385,172 S 10/1997 Bramsiepe et al.
D386,955 S 12/1997 Jones et al.
D388,609 S 1/1998 Chan
5,711,042 A 1/1998 Chuang
D394,792 S 6/1998 Bourque
D394,794 S 6/1998 Vasudeva
5,758,870 A 6/1998 Weaver
5,765,247 A 6/1998 Seber et al.
5,765,454 A 6/1998 Barbulescu et al.
5,791,211 A 8/1998 Bondhus et al.
5,803,584 A 9/1998 Chung
5,820,288 A 10/1998 Cole
D400,775 S 11/1998 Hsu
5,855,274 A 1/1999 Piao
D405,335 S 2/1999 Lin
5,911,799 A 6/1999 Johnson et al.
5,916,277 A 6/1999 Dallas
5,916,341 A 6/1999 Lin
5,918,513 A * 7/1999 Ho ..... 81/490
5,970,828 A 10/1999 Bondhus et al.
D415,946 S 11/1999 Tsai
5,983,759 A 11/1999 Turner
5,992,626 A 11/1999 Anderson
D420,885 S 2/2000 Lin
D426,449 S 6/2000 Eklind
D426,450 S 6/2000 Eklind
D427,875 S * 7/2000 Chiu ..... D8/105
6,085,620 A 7/2000 Anderson et al.
6,089,133 A 7/2000 Liao
6,092,656 A 7/2000 Ernst
6,095,018 A 8/2000 Schuster
6,105,767 A 8/2000 Vasudeva
6,119,560 A 9/2000 Anderson et al.
6,128,981 A 10/2000 Bondhus et al.
D433,613 S 11/2000 Jialin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,206,189 B1 3/2001 Huot, Jr. et al.
6,233,769 B1 5/2001 Seber et al.
6,237,451 B1 5/2001 Wei
6,279,434 B1 8/2001 Brown
D448,267 S 9/2001 Jean et al.
6,308,599 B1 10/2001 Fu-Hui
6,311,587 B1 11/2001 Johnson et al.
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
D455,630 S 4/2002 Chiu
6,382,057 B1 5/2002 Kienholz
6,389,931 B1 5/2002 Delaney et al.
6,397,709 B1 6/2002 Wall
6,401,576 B1 6/2002 Wu
6,405,620 B2 6/2002 Liao
D459,967 S 7/2002 Johnson et al.
D462,002 S 8/2002 Jean et al.
6,427,564 B1 8/2002 Nelson
6,490,954 B2 12/2002 Johnson et al.
6,510,766 B1 1/2003 Lin
6,510,767 B1 1/2003 Rivera
D470,739 S * 2/2003 Chen ..... D8/105
D472,712 S 4/2003 Sagen
D472,931 S 4/2003 Leins
6,564,680 B1 5/2003 Rinner et al.
6,598,503 B1 7/2003 Cunningham
D479,963 S 9/2003 Chang
6,675,678 B2 1/2004 Liu
6,698,318 B2 3/2004 Peters
6,739,224 B1 5/2004 Wershe
6,751,819 B2 6/2004 Chuang
6,752,046 B1 6/2004 Lee
6,758,350 B2 7/2004 Lin
6,763,744 B2 7/2004 Johnson et al.
D494,438 S 8/2004 Falkenstein et al.
6,799,490 B1 10/2004 Chu
6,877,186 B2 * 4/2005 Shiao ..... 16/111.1
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,941,843 B2 9/2005 Johnson et al.
6,948,406 B1 9/2005 Li
6,968,758 B2 11/2005 Lin
D517,391 S 3/2006 Leins
7,028,593 B1 4/2006 Lin et al.
7,051,629 B2 5/2006 Huang
D523,637 S 6/2006 Chang
7,073,418 B2 7/2006 Kuo
7,086,314 B2 8/2006 Wannop
7,093,519 B1 8/2006 Huang
D527,903 S 9/2006 Chan
7,100,476 B1 9/2006 Feit
7,131,358 B2 11/2006 Hsien
7,140,280 B2 11/2006 Hawkins et al.
7,143,669 B2 12/2006 Hu
7,150,208 B2 12/2006 Debley
7,159,260 B2 1/2007 Hansen
7,159,491 B1 1/2007 Chaconas et al.
7,165,479 B1 1/2007 Lee
7,168,345 B1 1/2007 Hsieh
7,182,003 B1 2/2007 Hsieh
7,216,569 B2 5/2007 Abdelgany
7,237,463 B1 7/2007 Lee
D548,464 S 8/2007 Lin
D549,069 S 8/2007 Lin et al.
7,281,454 B2 10/2007 Johnson et al.
7,284,466 B1 10/2007 Ho
D557,099 S 12/2007 Lin
7,305,908 B2 12/2007 Chi
7,467,574 B1 * 12/2008 Lin ..... 81/60
7,467,575 B2 12/2008 Lai
7,565,852 B2 7/2009 Yu
7,743,685 B2 6/2010 Chang
D623,037 S 9/2010 Johnson et al.
7,836,534 B2 * 11/2010 Simmons ..... 7/117
7,946,203 B2 5/2011 Johnson et al.
8,011,277 B2 9/2011 Johnson et al.
8,015,642 B1 * 9/2011 Oakley ..... 7/156
D650,257 S 12/2011 Royes et al.
2001/0005576 A1 6/2001 Rogers et al.
2003/0047474 A1 3/2003 Dahlson
2003/0126957 A1 7/2003 Huang
2003/0188610 A1 * 10/2003 Lin ..... 81/440
2003/0226428 A1 12/2003 Liu
2004/0050218 A1 3/2004 Napoli
2004/0173061 A1 9/2004 Liou
2004/0262344 A1 12/2004 White
2005/0011318 A1 1/2005 Tsai
2005/0229752 A1 10/2005 Nickipuck
2005/0247587 A1 11/2005 Holland-Letz
2005/0268752 A1 12/2005 Johnson et al.
2006/0101955 A1 5/2006 Chang
2006/0118500 A1 6/2006 Chen
2006/0150784 A1 7/2006 Hsieh
2006/0213059 A1 9/2006 Eggert
2006/0288823 A1 12/2006 Schepman
2007/0023306 A1 2/2007 Lai
2007/0151402 A1 7/2007 Schneeman et al.
2007/0221017 A1 9/2007 Heaven
2007/0228672 A1 10/2007 Huang
2007/0245862 A1 10/2007 Gonzalez et al.
2007/0295171 A1 12/2007 Johnson et al.
2008/0128370 A1 6/2008 Shih 2008/0148909 A1 6/2008 Lai
2008/0156754 A1 7/2008 Cheng
2008/0164171 A1 7/2008 Meng
2008/0190249 A1 8/2008 Yu
2008/0202963 A1 8/2008 Liao
2008/0251402 A1 10/2008 Chiu
2008/0271573 A1 11/2008 Lown et al.
2008/0295657 A1* 12/2008 Cluthe ..... 81/490
2009/0107303 A1 4/2009 Steinweg et al.
2009/0183608 A1 7/2009 Johnson et al.
2009/0183609 A1 7/2009 Johnson et al.
2009/0241740 A1 10/2009 Heagerty
2011/0000024 A1 1/2011 Johnson et al.

FOREIGN PATENT DOCUMENTS

JP 3-47775 5/1991
JP 4-29368 3/1992
JP 5-31882 4/1993

* cited by examiner

RADIAL FOLDOUT TOOL WITH MULTIPLE TYPES OF TOOLS AND BIT STORAGE

RELATED APPLICATIONS

This patent application is a continuation-in-part of the co-pending U.S. patent application Ser. No. 12/009,461, filed Jan. 17, 2008, entitled "RADIAL FOLDOUT TOOL," which is hereby incorporated by reference.

FIELD OF THE INVENTION

The present invention relates to the field of hand held tools. More specifically, the present invention relates to the field of folding multi-tool and related tools and safety, comfort, and convenience of accessories and tools.

BACKGROUND OF THE INVENTION

Hexagonal wrenches or tool drivers, also referred to as alien wrenches or L-wrenches, have a hexagonal L-shaped body, including a long leg member and a short leg member. The end of either leg member is able to be inserted into a head of a screw or tool designed to accept a hexagonal wrench. Once inserted, rotational pressure is applied to the hexagonal wrench in order to tighten or loosen the screw. The leg members of the hexagonal wrench are designed to be of different lengths in order to allow a user flexibility when using the wrench in different environments and situations. For example, in a narrow, confined environment, the long leg of the hexagonal wrench is inserted into the head of the screw and the user will apply rotational pressure to the short leg. Or, if the environment is not so confined, the user is able to insert the short leg of the hexagonal wrench into the head of the screw and apply rotational pressure to the long leg.

Hexagonal wrenches are manufactured and distributed in multiple English (e.g., standard) and metric sizes in order to facilitate their use with screw heads of multiple sizes. Such wrenches are usually sold in a set which includes wrenches of multiple sizes but are also distributed individually.

When using a hexagonal wrench, a user will insert an end of the hexagonal wrench into the head of a workpiece such as a screw, and will then exert rotational pressure on the opposite end of the wrench in order to tighten or loosen the screw. Because of the size and dimensions of the hexagonal wrench it is particularly difficult to exert a great amount of rotational pressure on the hexagonal wrench when the long leg of the hexagonal wrench is inserted into the head of the screw. Because the hexagonal wrench is typically turned with the user's fingers, the user is able to also experience scrapes and cuts from the use of hexagonal wrenches in this manner. Ingenuitive users have also used other tools, including vice grips, pliers and the like, to turn hexagonal wrenches. However, this method is disadvantageous because such tools are able to lose their hold on the hexagonal wrench when rotational pressure is applied or are able to even bend or otherwise disfigure the hexagonal wrench.

Socket wrenches, also referred to as ratchets, have a ratcheting mechanism and use interchangeable sockets to tighten or loosen nuts and bolts. The sockets are sized to fit different sized nuts and bolts. The ratcheting mechanism allows the nuts and bolts to be tightened or loosened with an alternating backward and forward motion. The sockets are manufactured and distributed in multiple English (e.g., standard) and metric sizes in order to facilitate their use with nuts and bolts of multiple sizes. Socket wrenches are usually sold in a set which includes sockets of different sizes but are also distributed individually.

Hexagonal wrenches and socket wrenches, among other tools, are commonly used. Yet, hexagonal wrenches and socket wrenches are separate tools. The user needs to gather these separate tools to work, for example, on a construction project. Multi-purpose devices allow the user to access different tools. Some multi-purpose devices have a blade, a corkscrew, scissors, and other tools for outdoor use but do not have tools for use during construction, carpentry, car repair, and the like. Other multi-purpose devices have tools, such as pliers, wire cutters, and drivers, but require the user to transform the multi-purpose device into a different configuration in order to access a particular tool. This method is disadvantageous because such a multi-purpose device does not provide easy access to any of the tools. In addition, once transformed into the right configuration, the multi-purpose device loses its convenient handle and, therefore, is awkward to grip onto.

SUMMARY OF THE INVENTION

A radial foldout tool includes a body with opposing ends and one or more sets of tool drivers. A first set of tool drivers are positioned on/near a first end and a second set of tool drivers are positioned on/near a second end. The tool drivers are contained within channels of the body when in a closed position. The tool drivers are also contained in a plurality of planes. The tool drivers open by rotating/moving in a direction at least perpendicular to a neighboring tool driver. When they are in an open position, each of the tool drivers are in/near the center of the end of the body. By being positioned in/near the center of the end, the radial foldout tool is able to be gripped and turned in a fashion similar to a standard screwdriver.

In one aspect, a device comprises a body having a center, a first end and a second end, wherein the first end and the second end are positioned on opposite ends of the body and a first set of tool drivers positioned within the body in a plurality of planes, wherein each tool driver of the first set of tool drivers is configured to be positioned generally in the center out of the first end in an open position. The device further comprises a second set of tool drivers positioned within the body in the plurality of planes, wherein the second set of tool drivers are configured to be positioned out of the second end. The first set of tool drivers and the second set of tool drivers are positioned within the body in a closed position. Each tool driver of the second set of tool drivers is positioned out of the second end in an open position. Each tool driver of the second set of tool drivers is positioned generally in the center of the second end in an open position. In some embodiments, a first tool driver of the first set of tool drivers is in the same plane as a second tool driver of the second set of tool drivers. The body includes a set of channels for the first set of tool drivers and the second set of tool drivers to be positioned in the closed position. In some embodiments, each tool driver of the first set of tool drivers is positioned at least 90° around the circumference of the first end away from a neighboring tool driver and each tool driver of the second set of tool drivers is positioned at least 90° around the circumference of the second end away from a neighboring tool driver. The body is generally cylindrical. In some embodiments, the first set of tool drivers and the second set of tool drivers are selected from the group consisting of hexagonal wrenches, screwdrivers, socket wrenches and star-shaped drivers. In some embodiments, the first set of tool drivers are hexagonal wrenches and the second set of tool drivers are screwdrivers. The device further comprises a stop within the body for preventing each of the first set of tool drivers from opening further. In some embodiments, each of the first set of tool drivers do not open further than 180°.

In another aspect, a device comprises a body having a center, the body including a plurality of faces, a first end and a second end, wherein the first end and the second end are positioned on opposite ends of the body, a first set of tool drivers, each tool driver of the first set of tool drivers positioned within the body on a face of the plurality of faces, wherein the first set of tool drivers are configured to be positioned generally in the center out of the first end in an open position and a second set of tool drivers, each tool driver of the second set of tool drivers positioned on a face of the plurality of faces within the body, wherein the first set of tool drivers are configured to be positioned generally in the center out of the second end in an open position. The first set of tool drivers and the second set of tool drivers are positioned within the body in a closed position. In some embodiments, a first tool driver of the first set of tool drivers is in the same plane as a second tool driver of the second set of tool drivers. The body includes a set of channels for the first set of tool drivers and the second set of tool drivers to be positioned in the closed position. Each tool driver of the first set of tool drivers and the second set of tool drivers is positioned in the open position by rotation in a substantially perpendicular direction away from the face. The body is generally cylindrical. In some embodiments, the first set of tool drivers and the second set of tool drivers are selected from the group consisting of hexagonal wrenches, screwdrivers, socket wrenches and star-shaped drivers. In some embodiments, the first set of tool drivers are hexagonal wrenches and the second set of tool drivers are screwdrivers. The device further comprises a stop within the body for preventing each of the first set of tool drivers and the second set of tool drivers from opening further.

In yet another aspect, a generally cylindrical tool handle having a body with a center, a first end and a second end and a generally cylindrical surface, the handle including a plurality of tool drivers each of a differing size in a plurality of planes, wherein each of the plurality of tool drivers includes an elongated rod coupled with the tool handle having a bend through a predetermined angle and including a proximal end for engaging an object, and a mounting end between the bend and a distal end, further wherein each tool driver of the set of tool drivers is positioned generally in the center of one of the first end and the second end in an open position. The set of tool drivers are positioned within the body in a closed position. In some embodiments, each tool driver of the set of tool drivers is positioned at least 90° around the circumference of one of the first end and the second end away from a neighboring tool driver. The tool handle further comprises a stop within the body for preventing each tool driver of the set of tool drivers from opening further.

In yet another aspect, a folding multi-tool comprises a body comprising one or more faces, a top end and a bottom end of the body, wherein the top end and the bottom end are positioned on opposite ends of the body, a plurality of tools stored against the one or more faces in a closed position, a first socket holder configured to secure a first set of sockets against the body, and a second socket holder configured to secure a second set of sockets against the body. In some embodiments, the first socket holder is configured to rotate about a first hinge coupled to the bottom end of the body, and the second socket holder is configured to rotate about a second hinge coupled to the bottom end of the body. Alternatively, the first socket holder and the second socket holder are press fit socket holders that are able to press into cavities of the body. The first socket holder and the second socket holder comprise a plurality of beds, wherein each bed is sized and configured to hold in place a socket. The socket is a metric size socket, a standard size socket, or other types of sockets. In some embodiments, the plurality of tools includes a set of tool drivers, wherein each tool driver of the set is configured to rotate about a rotatable mechanism coupled to the bottom end of the body. Each tool driver is arranged according to size, wherein a biggest tool driver is positioned generally near a middle of the body. In some embodiments, the plurality of tools includes a set of tool drivers, wherein each tool driver of the set is configured to rotate about a rotatable mechanism coupled to the top end of the body. Each tool driver is arranged according to size, wherein a biggest tool driver is positioned generally near a middle of the body. In some embodiments, the plurality of tools includes a drive, wherein the drive is configured to rotate about a rotatable mechanism coupled to the bottom end of the body, and wherein the drive is adapted to fit a socket. The drive is positioned generally near a middle of the body. In some embodiments, the plurality of tools includes a can opener, wherein the can opener is configured to rotate about a rotatable mechanism coupled to the bottom end of the body. The can opener is positioned generally near a middle of the body. In some embodiments, the plurality of tools includes a blade, wherein the blade is configured to rotate about an insert coupled to the top end of the body. In some embodiments, the folding multi-tool further comprises a bent loop coupled to top end of the body, wherein the bent loop is configured to attach the folding multi-tool to objects. In some embodiments, the folding multi-tool is configured to stand upright on the bottom end.

In yet another aspect, a foldout tool comprises a body comprising a plurality of faces, a top end of the body, and a bottom end of the body, wherein the top end and the bottom end are positioned on opposite ends of the body. The foldout tool further comprises a first socket storage coupled to a first face of the plurality of faces, wherein the first socket storage rotates about a first rotatable mechanism coupled to the bottom end of the body, a second socket storage coupled to a second face of the plurality of faces, wherein the second socket storage rotates about a second rotatable mechanism coupled to the bottom end of the body, and a drive coupled to a third face of the plurality of faces, wherein the drive rotates about a third rotatable mechanism coupled to the bottom end of the body, and wherein the drive is adapted to fit a socket. The first socket storage and the second socket storage comprise a plurality of chambers sized and configured to hold in place a plurality of sockets. The socket is a metric size socket or a standard size socket. In some embodiments, the foldout tool further comprises a can opener coupled to the third face, wherein the can opener rotates about the third rotatable mechanism. In some embodiments, the foldout tool further comprises a first set of tool drivers and a second set of tool drivers coupled to a fourth face, wherein each tool driver of the first set rotates about a fourth rotatable mechanism coupled to the bottom end of the body, and wherein each tool driver of the second set rotates about a fifth rotatable mechanism coupled to the top end of the body. In some embodiments, the foldout tool further comprises a blade, wherein the blade is configured to rotate about an insert coupled to the top end of the body. In some embodiments, the foldout tool further comprises a bent loop coupled to top end of the body, wherein the bent loop is configured to attach the foldout tool to objects. In some embodiments, the foldout tool is configured to stand upright on the bottom end of the foldout tool.

In yet another aspect, an apparatus comprises a body with a generally cylindrical surface, the body comprises a first end, a second end, and four faces, wherein each face has a plurality of tools, wherein each of the plurality of tools is positioned generally near a middle of the body, and wherein the apparatus is configured to stand upright on the second end. The four faces include a first face, wherein the first face comprises a bit storage and a hinge, wherein the bit storage holds at least one socket and rotates about the hinge, wherein the hinge is coupled to the second end of the body. The four faces includes a second face, wherein the second face comprises a bit storage and a hinge, wherein the bit storage holds at least one socket and rotates about the hinge coupled to the second end of the body. The four faces includes a third face, wherein the third face comprises a drive, a can opener, and a blade, wherein the drive and the can opener rotate about a rotatable mechanism coupled to the second end of the body, and the blade rotates about an insert coupled to the first end of the body. The four faces includes a fourth face, wherein the fourth face comprises a first set of tool drivers and a second set of tool drivers, wherein each tool driver of the first set rotates about a first pivotable mechanism coupled to the second end of the body, and wherein each tool driver of the second set rotates about a second pivotable mechanism coupled to the first end of the body.

In yet another aspect, a tool handle comprises a body and a plurality of tools. The body comprises a first face of the body, a second face of the body, a third face of the body, wherein the third face is opposite the first face, a fourth face of the body, wherein the fourth face is opposite the second face, a top end of the body, and a bottom end of the body, wherein the top end and the bottom end are positioned on opposite ends of the body. The plurality of tools comprises a bent loop coupled to top end of the body, wherein the bent wire loop is configured to attach the tool handle to objects, a first depository comprising a first plurality of chambers sized and configured to hold in place metric size sockets, wherein the first depository is coupled to the first face, and wherein the first depository rotates about a first rotatable mechanism coupled to the bottom end of the body, a second depository comprising a second plurality of chambers sized and configured to hold in place standard size sockets, wherein the second depository is coupled to the third face, and wherein the second depository rotates about a second rotatable mechanism coupled to the bottom end of the body, a drive coupled to the second face, wherein the drive rotates about a third rotatable mechanism coupled to the bottom end of the body, and wherein the drive is adapted to fit ends of the metric size sockets and ends of the standard size sockets, a can opener coupled to the second face, wherein the can opener rotates about the third rotatable mechanism, a blade coupled to the second face, wherein the blade is configured to rotate about a fourth rotatable mechanism coupled to the top end of the body, a first set of tool drivers coupled to the fourth face, wherein each tool driver of the first set rotates about a fifth rotatable mechanism coupled to the bottom end of the body, and a second set of tool drivers coupled to the fourth face, wherein each tool driver of the second set rotates about a sixth rotatable mechanism coupled to the top end of the body. The tool handle is configured to stand upright on the bottom end of the body. In some embodiments, each face of the body is rounded.

DETAILED DESCRIPTION

In the following description, numerous details are set forth for purposes of explanation. However, one of ordinary skill in the art will realize that the invention may be practiced without the use of these specific details or with equivalent alternatives. Thus, the present invention is not intended to be limited to the embodiments shown but is to be accorded the widest scope consistent with the principles and features described herein.

Reference will now be made in detail to implementations of the present invention as illustrated in the accompanying drawings. The same reference indicators will be used throughout the drawings and the following detailed description to refer to the same or like parts.

Embodiments of the present invention are directed to a radial foldout tool.

Radial Foldout Tool

In some embodiments, a radial foldout tool stores tool drivers in a compact configuration. The tool drivers are able to be positioned for use to tighten or loosen an object such as a screw or bolt.

Figure 1:
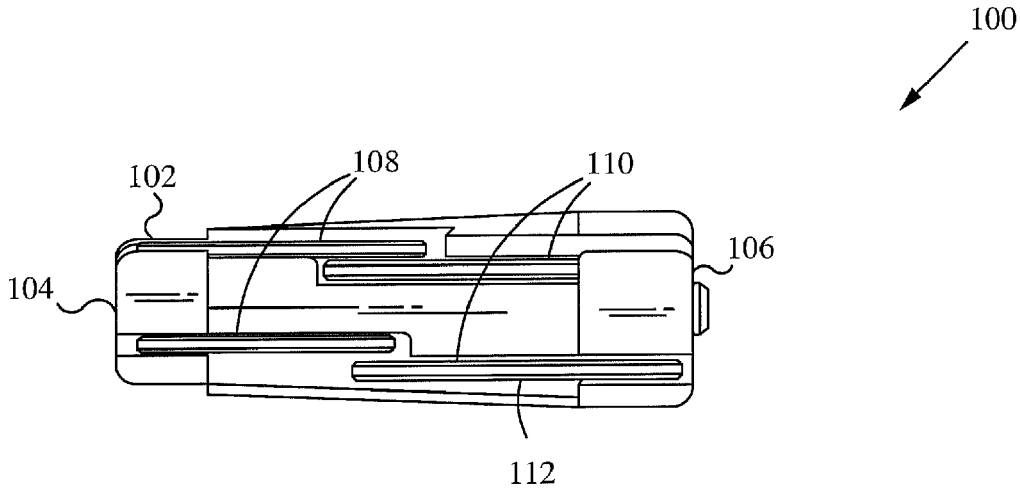
FIG. 1 illustrates an isometric view of a radial foldout tool in a closed position in accordance with the present invention.

FIG. 1 illustrates an isometric view of a radial foldout tool 100 in a closed position in accordance with the present invention. A first set of tool drivers 108 is coupled to or near a first end 104 of a body 102 of the radial foldout tool 100. Each tool driver 112 of the first set of tool drivers 108 is coupled so that it is able to rotate out to an open position. In some embodiments, each of the first set of tool drivers 108, when stored in a closed position, fits securely within a different channel of the body 102. A second set of tool drivers 110 is coupled to or near a second end 106 of the body 102 of the radial foldout tool 100. Each tool driver 112 of the second set of tool drivers 110 is coupled so that it is able to rotate out to an open position. In some embodiments, each of the second set of tool drivers 110, when stored in a closed position, fits securely within a different channel of the body 102.

In some embodiments, each of the tool drivers 112 of the first set of tool drivers 108 is positioned in the body 102 in a different plane from the other tool drivers of the first set of tool drivers 108. Similarly, in some embodiments, each of the tool drivers 112 of the second set of tool drivers 110 is positioned in the body 102 in a different plane from the other tool drivers of the second set of tool drivers 110. For example, in a radial foldout tool 100 which has a body 102 that is generally cylindrical in shape and surface, a first tool driver is positioned at 0° along the circumference of a round first end of the tool, a second tool driver is positioned at 120° along the circumference and a third tool driver is positioned at 240° along the circumference. Tool drivers are similarly positioned on the opposite end as well.

In some embodiments, each tool driver of the first set of tool drivers 108 is positioned in the same plane as a correspondingly positioned tool driver of the second set of tool drivers 110.

In some embodiments, each of the tool drivers of the radial foldout tool 100 is configured to open at least perpendicularly to its neighboring tool driver. For example, with a radial foldout tool 100 containing three tool drivers at each end, a first tool driver opens at 0°, a second tool driver opens at 90° and a third tool driver opens at 270°. This configuration enables each of the tool drivers to open into/near the middle/center of the end, so that a user has better and easier turning power instead of the awkward turning capabilities when the tool drivers are not positioned near the middle of the end. In other words, each of the tool drivers fold out to a position as close as possible to a central axis of the radial foldout tool 100.

In some embodiments, a hard stop such as an internal wall prevents the tool drivers from opening past a certain angle such as 180° so that the tool extends perpendicular to the corresponding end.

Figure 2:
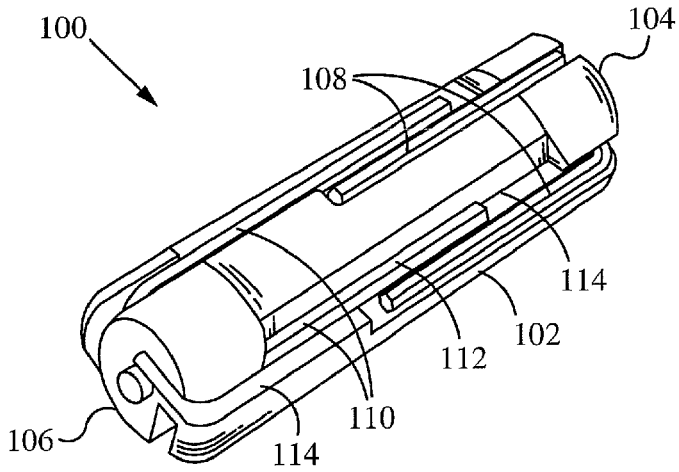
FIG. 2 illustrates a perspective view of a radial foldout tool in a closed position in accordance with the present invention.

FIG. 2 illustrates a perspective view of a radial foldout tool 100 in a closed position in accordance with the present invention. A first set of tool drivers 108 is coupled to or near a first end 104 of a body 102 of the radial foldout tool 100. The first set of tool drivers 108 is coupled so that the tool drivers 112 are able to rotate out to an open position. In some embodiments, each of the first set of tool drivers 108, when stored in a closed position, fits securely within a different channel 114 of the body 102. A second set of tool drivers 110 is coupled to or near a second end 106 of the body 102 of the radial foldout tool 100. The second set of tool drivers 110 is coupled so that the tool drivers 112 are able to rotate out to an open position. In some embodiments, each of the second set of tool drivers 110, when stored in a closed position, fits securely within a different channel 114 of the body 102.

Figure 3:
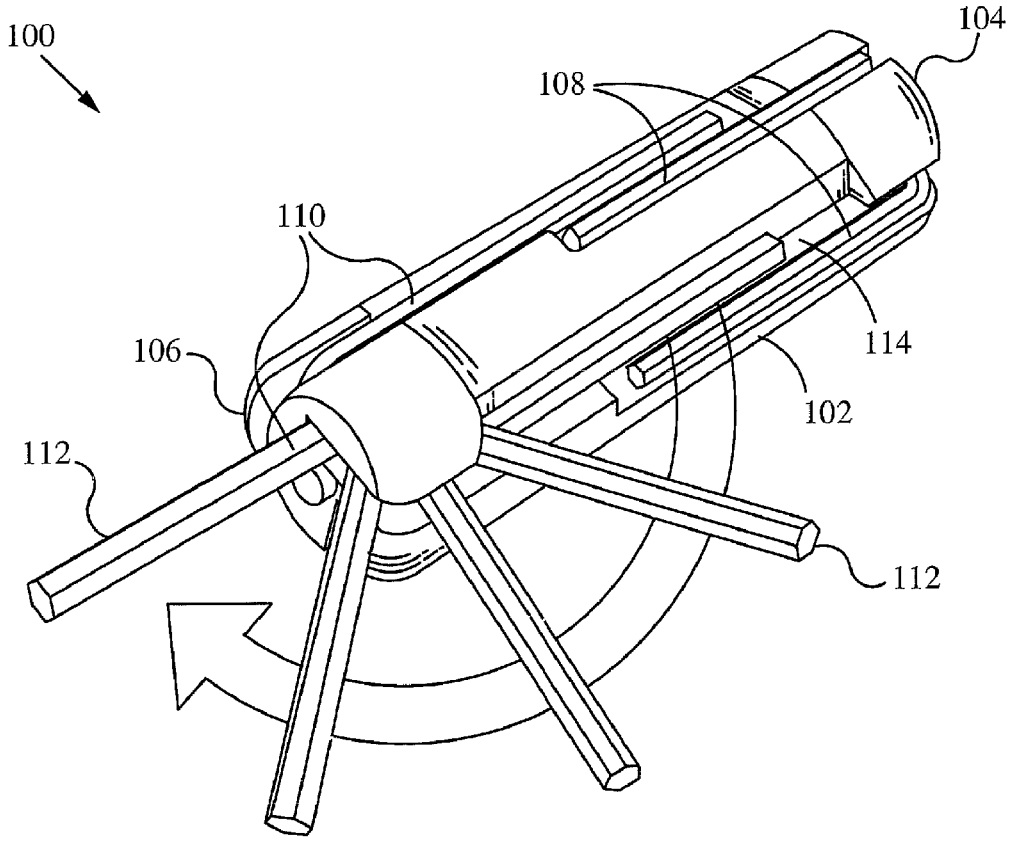
FIG. 3 illustrates a perspective view of a radial foldout tool with a tool driver moving from a closed position to an open position in accordance with the present invention.

FIG. 3 illustrates a perspective view of a radial foldout tool 100 with a tool driver moving from a closed position to an open position in accordance with the present invention. When positioned in a closed position, the tool driver 112 is stored within a channel 114, in some embodiments. A user is able to rotate the tool driver 112 to an open position as shown. In some embodiments, the tool driver 112 is limited in the direction it is able to rotate, such that it rotates away from the channel 114 in which it is stored. Furthermore, the tool driver's rotational range is limited so that the tool driver 112 stops rotating once it is pointing in a parallel direction to the body 102. In an open position, the tool driver 112 is also generally in the middle of the end of the body 102. In other words, the tool driver 112 folds out to a position as close as possible to the central axis of the radial foldout tool 100. To position the tool driver 112 in a closed position, a user rotates the tool driver 112 in an opposite direction from the opening direction so that the tool driver 112 rests within the channel 114, in some embodiments.

Figure 4:
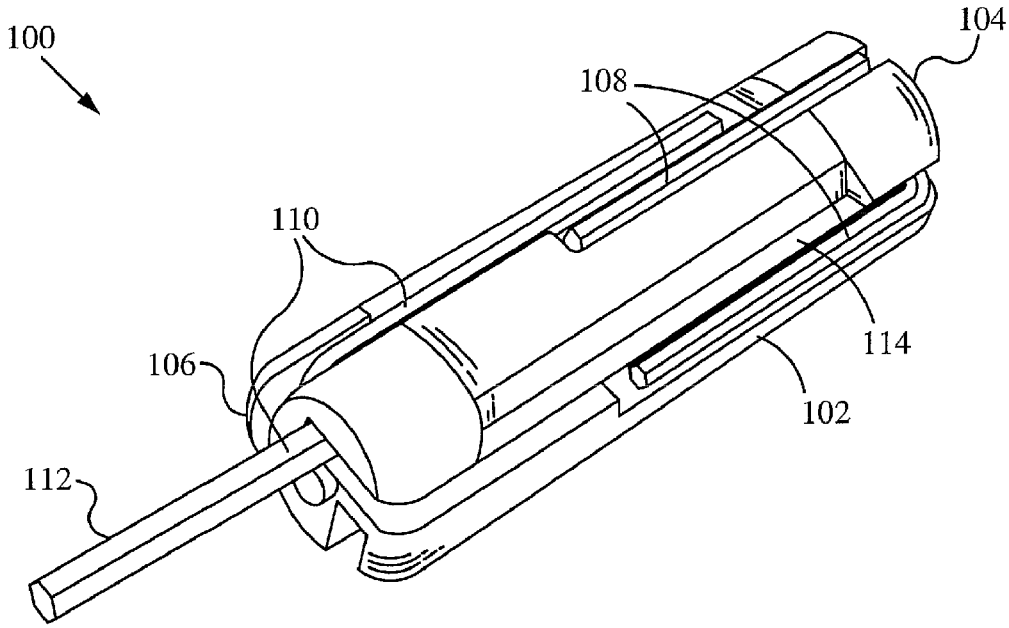
FIG. 4 illustrates a perspective view of a radial foldout tool in an open position in accordance with the present invention.

FIG. 4 illustrates a perspective view of a radial foldout tool 100 in an open position in accordance with the present invention. When in an open position, a tool driver 112 is positioned pointing in a parallel direction to the body 102 and generally in the middle of the end of the body 102, in some embodiments. This enables users to grip the body 102 as a handle and use the radial foldout tool 100 similarly to a screw driver or other tool that has a body with a tool driver protruding out of the middle of the handle. The radial foldout tool 100 is intended to be used with one of the tool drivers 112 in an open position. While one of the tool drivers 112 is in an open position, the other tool drivers 112 are typically in a closed position.

Figure 5:
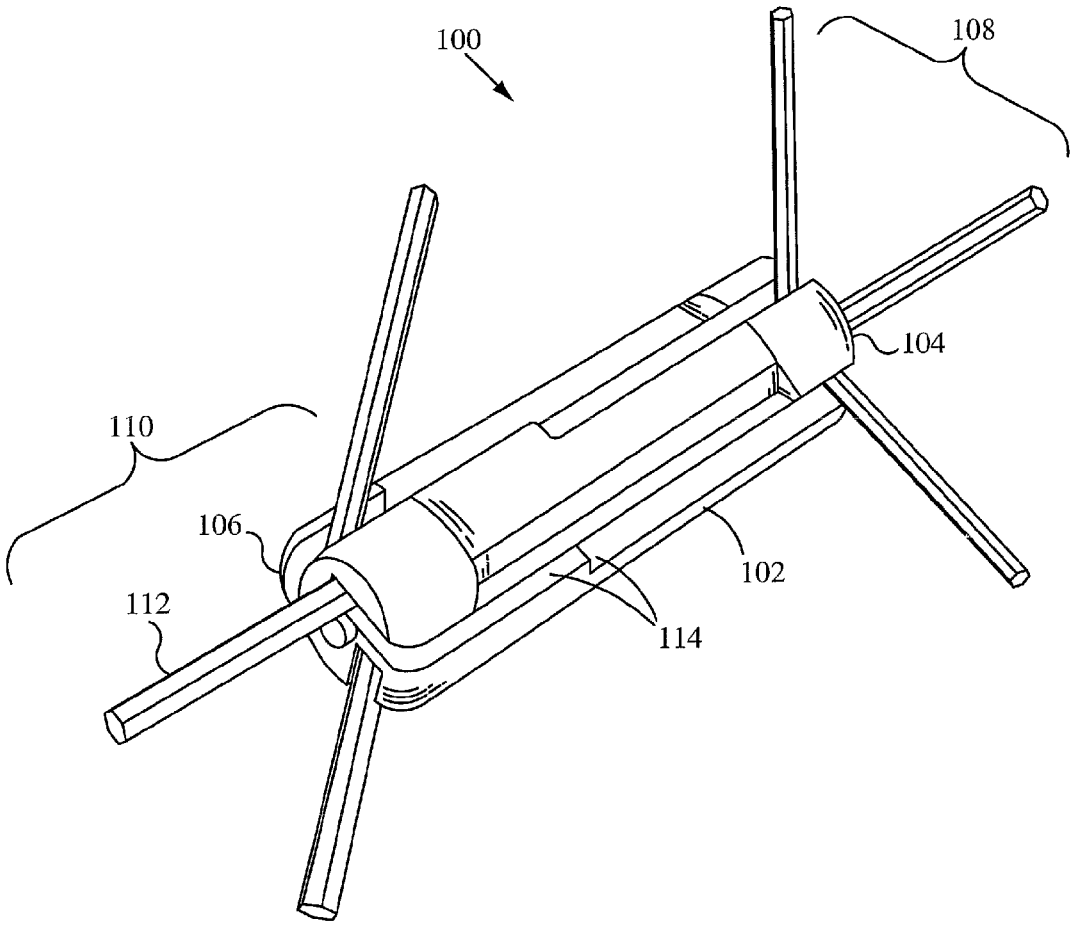
FIG. 5 illustrates a perspective view of a radial foldout tool with all of the tool drivers in an open or partially open position in accordance with the present invention.

FIG. 5 illustrates a perspective view of a radial foldout tool 100 with all of the tool drivers in an open or partially open position in accordance with the present invention. The drawing of FIG. 5 is for illustration purposes only. When in use, the radial foldout tool 100 is designed to work with one tool driver open at a time.

In some embodiments, the radial foldout tool 100 is designed to include some hexagonal wrenches of English (e.g., standard) sizes including a ¼ inch hexagonal wrench, a 7/32 inch hexagonal wrench, a 3/16 inch hexagonal wrench, a 5/32 inch hexagonal wrench, a 9/64 inch hexagonal wrench, a ⅛ inch hexagonal wrench, a 7/64 inch hexagonal wrench, a 3/32 inch hexagonal wrench and a 5/64 inch hexagonal wrench.

In some embodiments, the radial foldout tool 100 is designed to include some hexagonal wrenches of metric sizes including an 8 mm hexagonal wrench, a 6 mm hexagonal wrench, a 5 mm hexagonal wrench, a 4 mm hexagonal wrench, a 3 mm hexagonal wrench, a 2.5 mm hexagonal wrench, a 2 mm hexagonal wrench and a 1.5 mm hexagonal wrench. It should be apparent to one skilled in the art that a radial foldout tool 100 is able to be formed to hold fewer, additional or different sizes of hexagonal wrenches.

In some embodiments, the radial foldout tool 100 is designed to be of a round shape. In some embodiments, the radial foldout tool 100 is designed to be of a triangular shape including three faces, a square or rectangle shape including four faces, a hexagonal shape including six faces or any other appropriate shape. In some embodiments, a single tool driver is positioned on each face of the radial foldout tool 100. In some embodiments, each face is approximately 1 inch across its width and the body 102 of the radial foldout tool 100 is approximately 4.5 inches in length. The body 102 is designed to provide a comfortable, user-friendly interface to a user's hand, in order to enhance a user's ability to exert rotational pressure on the tool driver 112 without subjecting the user to personal injury or requiring the use of additional tools. As should be apparent to one skilled in the art, the body 102 of the present invention may be designed to be of any convenient shape, including any number of faces.

Figure 6A:
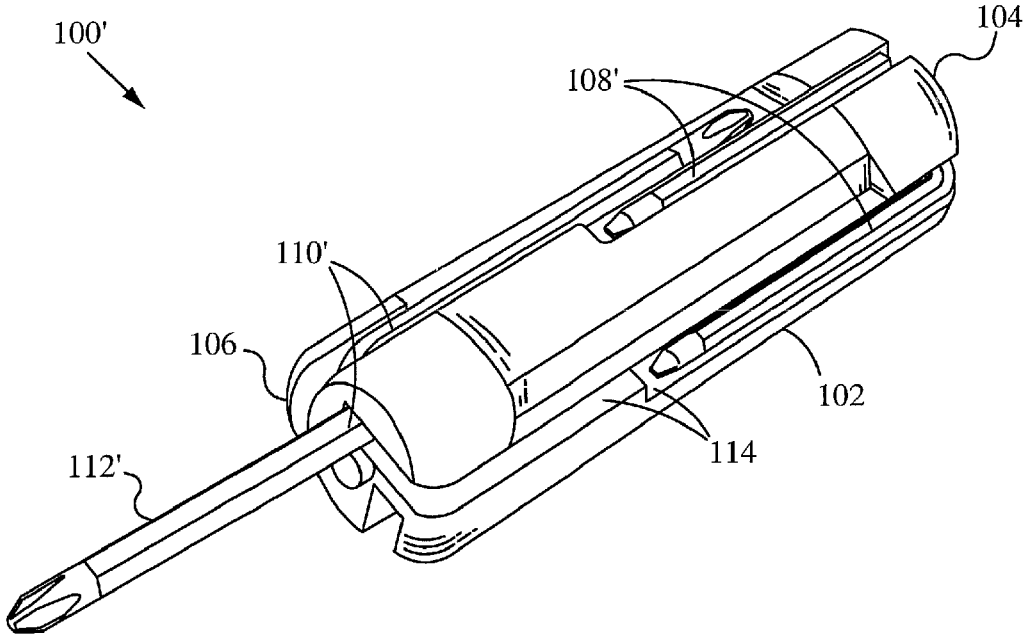
FIG. 6A illustrates a perspective view of a radial foldout tool with alternative tool drivers in accordance with the present invention.
Figure 6B:
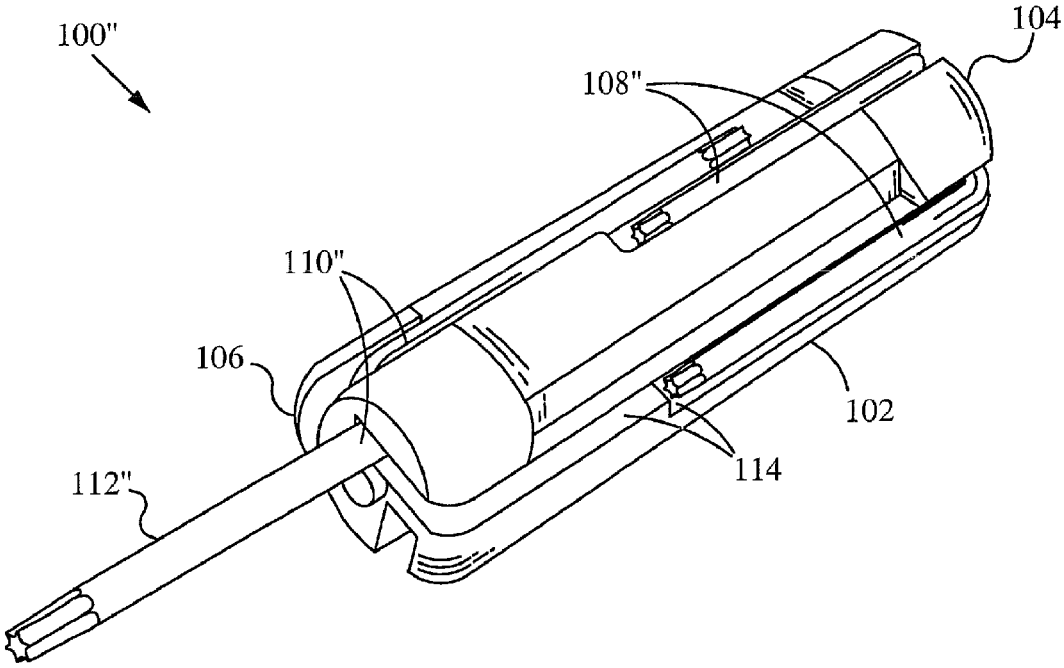
FIG. 6B illustrates a perspective view of a radial foldout tool with alternative tool drivers in accordance with the present invention.
Figure 6C:
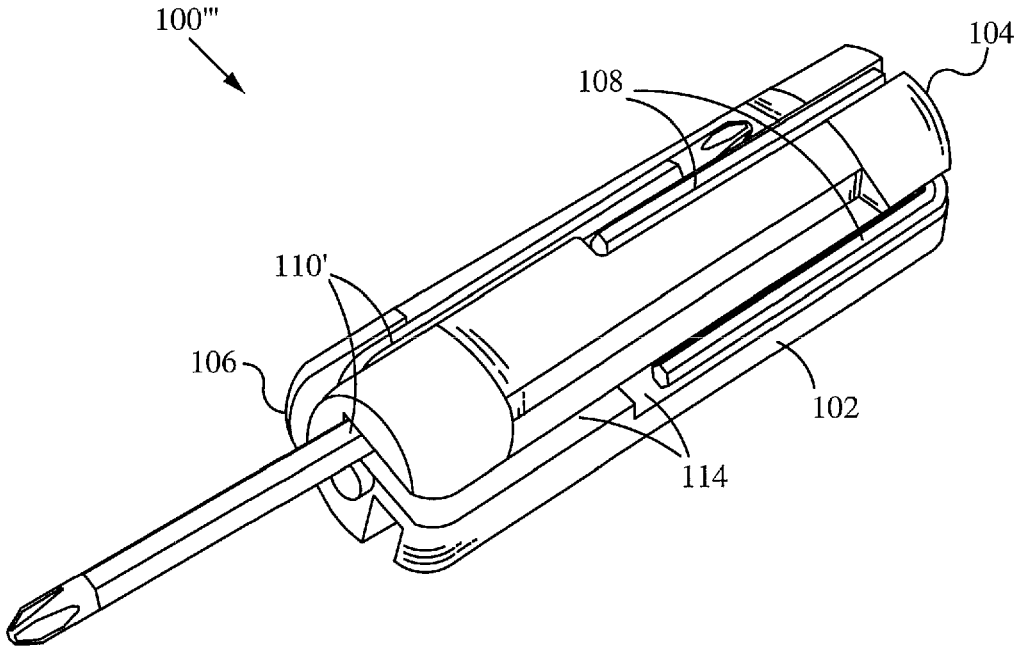
FIG. 6C illustrates a perspective view of a radial foldout tool with alternative tool drivers in accordance with the present invention.

FIGS. 6A, 6B and 6C each illustrates a perspective view of a radial foldout tool with alternative tool drivers in accordance with the present invention. FIG. 6A illustrates a radial foldout tool 100' with screwdrivers as tool drivers 112'. The body 102 is similar to or the same as embodiments above with two opposing ends 104 and 106. Additionally, the channels 114 are also similar to or the same as embodiments above. However, in this embodiment, a first set of tool drivers 108' includes flat head screwdrivers, and the second set of tool drivers 110' includes phillips head screwdrivers. In some embodiments, the sizes and/or shapes of the heads of the screwdrivers vary. For example, the sizes of the screwdriver heads are able to vary to small enough for use with a tiny screw for securing eyeglass components together up to much larger screws. Also, for varying shapes, at times a more pointed screwdriver is necessary for a screw while other times a flatter screwdriver is necessary or preferred. The thickness of the screwdriver tip varies, in some embodiments. In some embodiments, the first set and the second set of tool drivers are all flat head screwdrivers or phillips head screwdrivers. Any variations of screwdrivers are possible.

FIG. 6B illustrates a radial foldout tool 100" with star-shaped drivers as tool drivers 112". As described above in reference to FIG. 6A, the body 102 with two opposing ends 104 and 106 is similar to or the same as well as the channels 114 for previous embodiments. However, in this embodiment, the first and second sets of tool drivers 108" and 110" are star-shaped drivers. The star-shaped drivers vary in size, tip recess (security star) and/or any other characteristic.

FIG. 6C illustrates a radial foldout tool 100''' with both screwdrivers and hexagonal wrenches as tool drivers. Again, the body 102 with two opposing ends 104 and 106 and the channels 114 are similar to or the same as in previous embodiments. However, instead of simply having one type of tool driver, such as hexagonal wrenches, multiple sets of tool drivers are included such as hexagonal wrenches and screwdrivers. In the embodiment shown, a first set of tool drivers 108 includes hexagonal wrenches and a second set of tool drivers 110' includes screwdrivers. Furthermore, the screwdrivers are able to be one type of screwdriver with varying shapes and sizes, and/or are able to include multiple types of screwdrivers such as flat heads and phillips head screwdrivers. While an example of a radial foldout tool with screwdrivers and hexagonal wrenches has been shown, other types of combination tools are possible such as screwdrivers and star-shaped drivers, hexagonal wrenches and star-shaped drivers, hexagonal wrenches and socket wrenches, combinations of three or more tool drivers or any other combinations of tool drivers.

Figure 7:
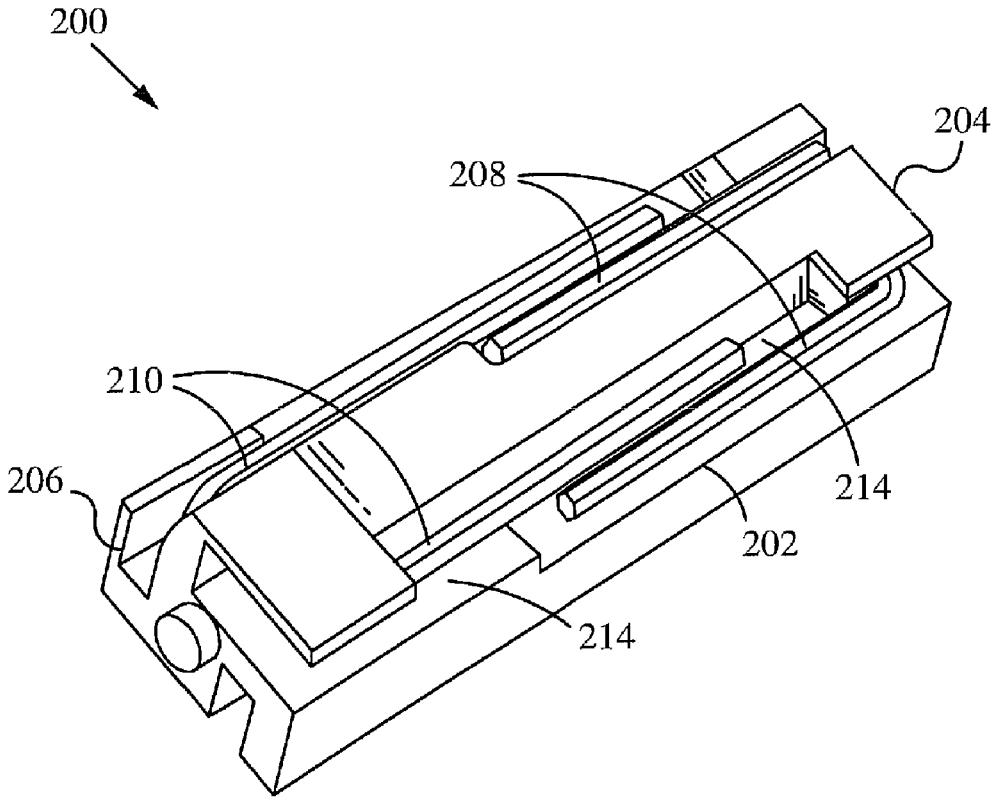
FIG. 7 illustrates a perspective view of a radial foldout tool with a plurality of faces in a closed position in accordance with the present invention.

FIG. 7 illustrates a perspective view of a radial foldout tool 200 with a plurality of faces in a closed position in accordance with the present invention. A first set of tool drivers 208 is coupled to or near a first end 204 of a body 202 of the radial foldout tool 200. The first set of tool drivers 208 is coupled so that the tool drivers 208 are able to rotate out to an open position. In some embodiments, each of the first set of tool drivers 208, when stored in a closed position, fits securely within a different channel 214 of the body 202. A second set of tool drivers 210 is coupled to or near a second end 206 of the body 202 of the radial foldout tool 200. The second set of tool drivers 210 is coupled so that the tool drivers 212 are able to rotate out to an open position. In some embodiments, each of the second set of tool drivers 210, when stored in a closed position, fits securely within a different channel 214 of the body 202. In some embodiments, some of the faces contain two or more tool drivers. In some embodiments, each of the faces contain a single tool driver. As described in detail below, in other embodiments, each of the faces contain at least one tool driver.

As described in this section, the tool drivers in some embodiments are configured to rotate to an open position which is generally in the middle/center of each end of the body of the radial foldout tool. In other words, the tool drivers each folds out to a position as close as possible to a central axis of the radial foldout tool. By being near the middle of each end, turning the radial foldout tool is more stable for a user when the radial foldout tool is in use and each of the tool drivers is in use. The tool drivers are also stored in a plurality of planes in the body which help ensure the tool drivers open to the middle of each end. Since the tool drivers are stored in a plurality of planes, the tool drivers open in a direction at least perpendicular to their neighboring tool driver to further ensure they open to the middle of each end of the radial foldout tool. Previously existing foldout tools suffer from an awkward grasping implementation where the awkwardness is due to the fact that, in the worst case, for example, the previously existing tools allow for the smallest of wrenches to place the part of the tool that is grasped and turned, as far off-axis as possible (and without the benefit of a hard stop in the fully extended position as the present radial foldout tool does). In addition to that, since the previously existing tools are rectangular cubes, the user's hand is required to either fully disengage the tool between turns, or to use rather involved spider-like, alternating stepping actions with the fingers to crawl the hand around the tool into position for the next twist, all the while, keeping the tool stabilized in multiple axes due to the fact that the grasp is compromised and that the wrench, when fully extended, is able to rotate at least 270°. Whereas, with the present radial foldout tool design, the user's hand is able to simply loosen the grasp and slide the palm around within the circumference of the tool while maintaining a steady and sure grasp on the tool, wrench and fastener.

In operation, a radial foldout tool contains multiple tool drivers to consolidate the space needed for a set of tool drivers. Furthermore, the body of the radial foldout tool contains channels for storing the tool drivers in a closed position, so that more tools are able to be stored. To utilize the radial foldout tool, a user moves a desired tool driver from a closed position to an open position. The user moves the desired tool driver using a finger or two to simply pull or push the tool driver in the appropriate direction. In some embodiments, the tool driver locks into place in the open position. The user then grasps the body of the radial foldout tool similarly to grasping a handle of a screwdriver. The user turns the body of the radial foldout tool to either tighten or loosen an object such as a screw or bolt. This turning action is also similar to the use of a screwdriver. Once the user has performed the tightening or loosening actions on the desired object or objects, the tool driver is moved to a closed position by pushing or pulling the tool driver with the user's fingers. In some embodiments, the tool drivers lock in the closed position. When in the closed position, the tools are safely stored within channels in the body to prevent injuries. Unlike a standard screwdriver which has a sharp point jutting out of the handle, the radial foldout tool is able to be compacted and stored safely.

Radial Foldout Tool with Multiple Types of Tools and Bit Storage

In some embodiments, a radial foldout tool has multiple types of tools and bit storage. As such, the radial foldout tool is a general purpose folding multi-tool. FIGS. 8A-8E each illustrates an isometric view of the radial foldout tool 300 in a closed position in accordance with the present invention. In some embodiments, the radial foldout tool 300 has a body 302 comprising a plurality of faces; yet, the body 302 is generally cylindrical in shape and surface. In other words, each face is well-rounded. In some embodiments, the radial foldout tool 300 has a height of approximately 4.5", although other measurements are possible. In some embodiments, the radial foldout tool 300 has a bent loop 304 coupled to a top end of the radial foldout tool 300. The bent loop 304 can be used to attach or hook the radial foldout tool 300 to objects. Although the bent loop 304 is typically made from stainless metal, the bent loop 304 can be made from any other suitable material such as plastic. In some embodiments, the bent loop 304 is coated in chrome or other suitable compound.

In some embodiments, the radial foldout tool 300 has two bit holders. A first bit holder holds hex sockets of English (e.g., standard) sizes including a ⅜ inch hex socket, a 5/16 inch hex socket, a ¼ inch hex socket and a 3/16 inch hex socket. A second bit holder holds hex sockets of metric sizes including a 10 mm hex socket, a 8 mm hex socket, a 6 mm hex socket and a 5 mm hex socket.

Figure 8A:
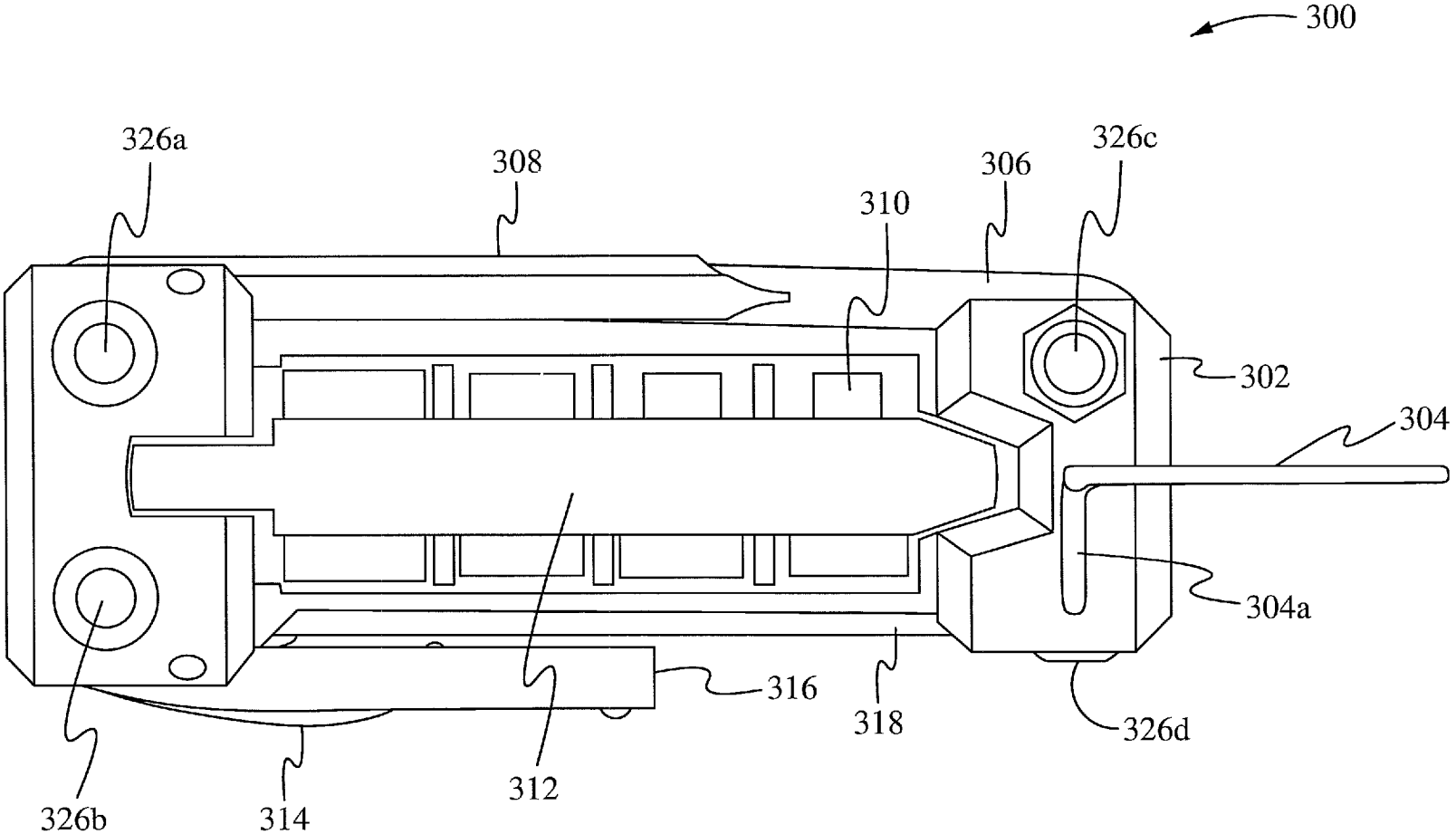
FIG. 8A illustrates an isometric view of a radial foldout tool in a closed position in accordance with the present invention.
Figure 11A:
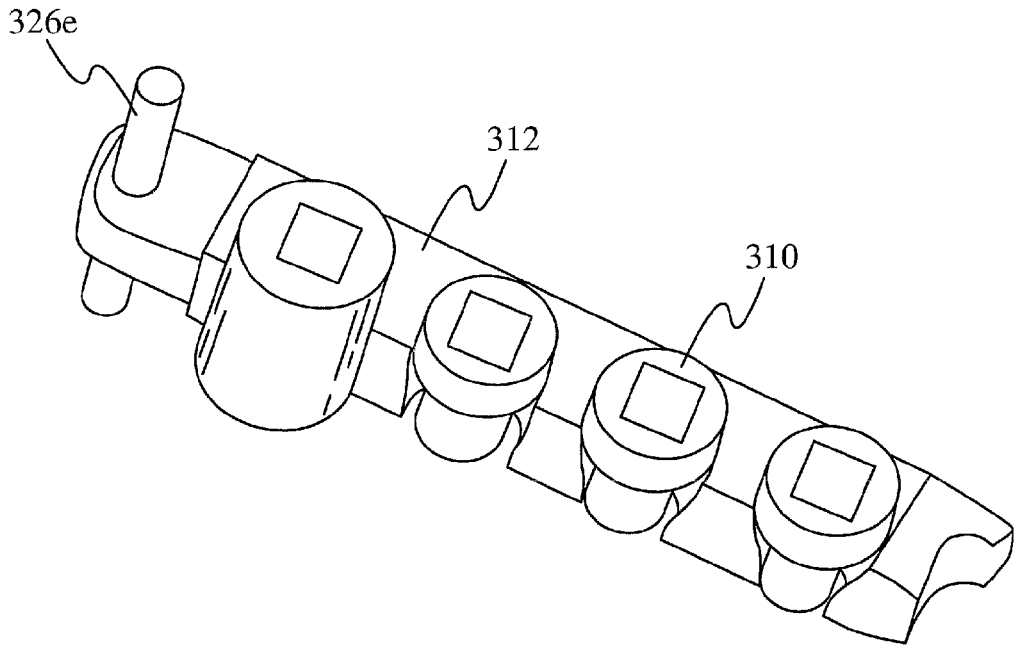
FIG. 11A illustrates a perspective view of a first bit holder with an inserted hinge at a rotational end of the first bit holder in accordance with the present invention.

FIG. 8A illustrates an isometric view of a first face of the radial foldout tool 300. As illustrated in FIG. 8A, the first bit holder 312 holds the four standard size hex sockets 310 against the body 302 of the radial foldout tool 300 in a closed position. To retrieve a standard size hex socket 310, the first bit holder 312 rotates out and away from the body 302 to an open position. In some embodiments, the first bit holder 312 rotates about a rotatable or pivotable mechanism, such as a rod, a peg or a hinge, to name a few, within a bottom end of the radial foldout tool 300 to the open position. In some embodiments, a hard stop prevents the first bit holder 312 from opening past a certain angle such as 90° so that when the first bit holder 312 stops rotating, the first bit holder 312 is pointing perpendicular to the body 302. FIG. 11A illustrates a perspective view of the first bit holder 312 with a hinge 326*e* coupled at the rotational end of the first bit holder 312. The hinge 326*e* is not illustrated in FIG. 8A as it is positioned within the body 302 and is, thus, obscured from view.

Figure 8B:
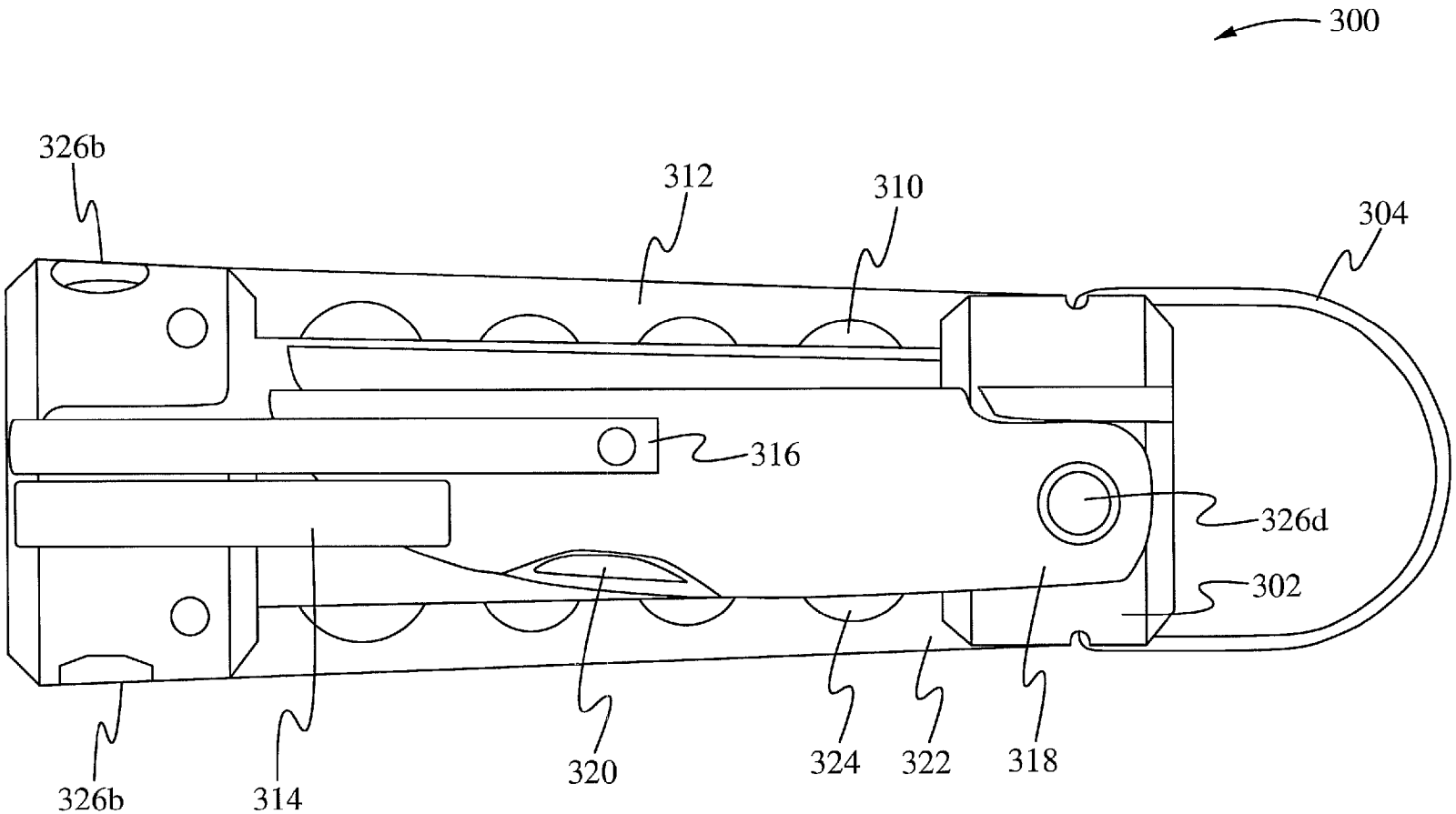
FIG. 8B illustrates an isometric view of a radial foldout tool in a closed position in accordance with the present invention.
Figure 8C:
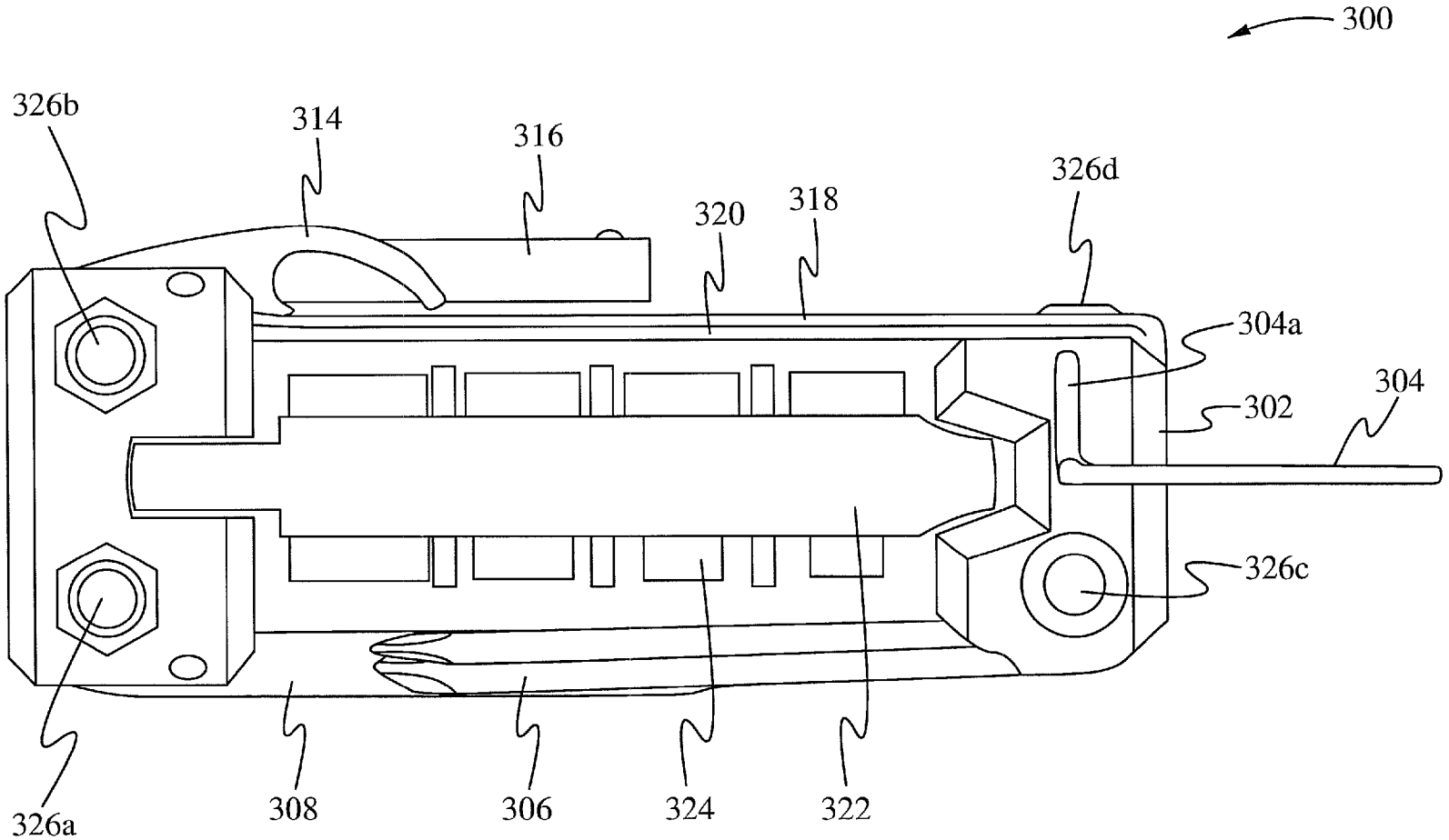
FIG. 8C illustrates an isometric view of a radial foldout tool in a closed position in accordance with the present invention.
Figure 11B:
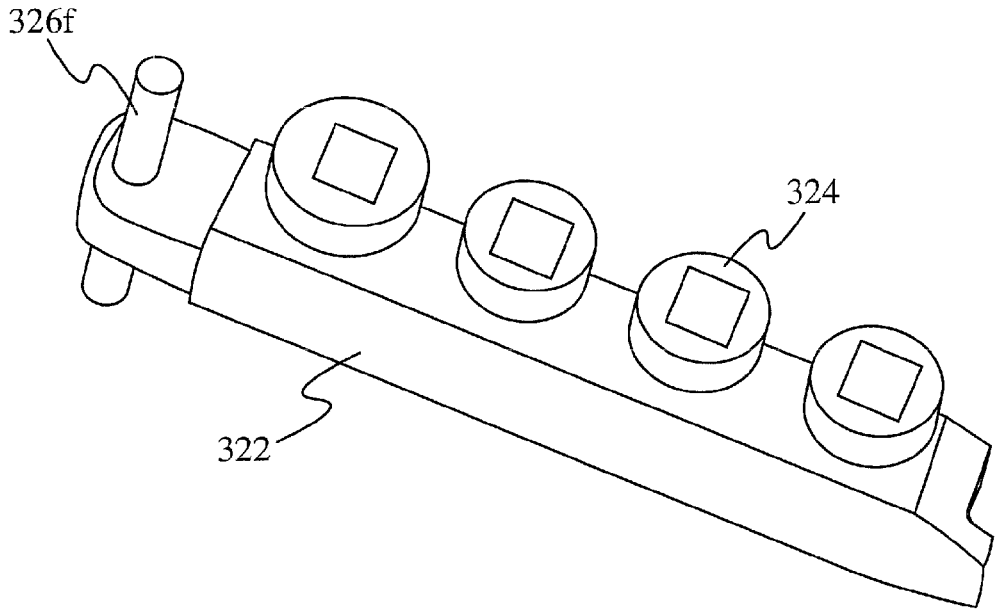
FIG. 11B illustrates a perspective view of a second bit holder with an inserted hinge at a rotational end of the second bit holder in accordance with the present invention.

FIG. 8C illustrates an isometric view of a third face of the radial foldout tool 300. As illustrated in FIG. 8C, the second bit holder 322 holds the four metric size hex sockets 324 against the body 302 of the radial foldout tool 300 in a closed position. The second bit holder 322 is similarly configured as the first bit holder 312. To retrieve a metric size hex socket 324, the second bit holder 322 rotates out and away from the body 302 to an open position. In some embodiments, the second bit holder 322 rotates about a rotatable mechanism, such as a hinge, within the bottom end of the radial foldout tool 300 to the open position. In some embodiments, a hard stop prevents the second bit holder 322 from opening past a certain angle such as 90° so that when the second bit holder 322 stops rotating, the second bit holder 322 is pointing perpendicular to the body 302. FIG. 11B illustrates a perspective view of the second bit holder 322 with a hinge 326*f* coupled at the rotational end of the second bit holder 322. The hinge 326*f* is not illustrated in FIG. 8C as it is positioned within the body 302 and is, thus, obscured from view. It should be apparent to one skilled in the art that the radial foldout tool 300 is able to be formed to hold fewer, additional or different sizes or shapes of sockets.

Also illustrated in FIGS. 8A and 8C, a notch 304*a* near the top end of the radial foldout tool 300 allows the bent loop 304 to fold down and rest securely within the notch 304*a*. The bent loop 304 is configured to swivel from the resting (horizontal) position to a standing (vertical) position. In some embodiments, the standing position is perpendicular to the resting position.

Alternatively, the bit holders 312, 322 are press fit socket holders that are able to completely separate from the body 302. The press fit socket holders are removably coupled to the body 302 without a rotatable or pivotable mechanism. Instead, the press fit socket holders press into cavities of the body 302.

In some embodiments, the radial foldout tool 300 typically has a drive configured to be used with the hex sockets. In some embodiments, the drive is a ¼ inch square drive, which fits within ends of the hex sockets. Alternatively, the drive can be of any size and shape, configured to fit within ends of different sockets.

FIG. 8B illustrates an isometric view of a second face of the radial foldout tool 300. As illustrated in FIG. 8B, the drive 316 and a bottle or can opener 314 are coupled to the bottom end of the radial foldout tool 300 in a closed position. To use the drive 316 and the bottle opener 314, the drive 316 and the bottle opener 314 rotate out and away from the body 302 to a usable position. In some embodiments, the drive 316 and the bottle opener 314 rotate about a rotatable mechanism, such as a dowel or screw 326*b*, within the bottom end of the radial foldout tool 300 to the usable position. In some embodiments, a hard stop prevents the drive 316 and the bottle opener 314 from opening past a certain angle such as 180° so that when the drive 316 and the bottle opener 314 stop rotating, the drive 316 and the bottle opener 314 are pointing in a parallel direction to the body 302.

In some embodiments, the drive 316 and the bottle opener 314 are positioned next to each other in a middle or center of the second face such that the drive 316 and the bottle opener 314 fold out to a position as close as possible to a central axis of the radial foldout tool 300. This configuration enables a user to have a better and easier handle of the radial foldout tool 300 during use. For example, the drive 316 positioned near the middle of the bottom end allows the user to have a better turning power instead of the awkward turning capabilities when the drive 316 is not positioned near the middle of the bottom. The bottle opener 314 positioned near the middle of the bottom end allows the user to have a better grip of the radial foldout tool 300 when opening a bottle, a can and the like.

In some embodiments, the radial foldout tool 300 also has a blade 320 protected behind a protective covering 318, in a closed position, coupled to the second face of the radial foldout tool 300. The protective covering 318 is typically positioned behind the drive 316 and the bottle opener 314. In some embodiments, the blade 320 is three inches long and fans open to a side, rotating about a rotatable mechanism, such as a pin or a threaded insert 326*d*, coupled to the top end of the radial foldout tool 300, as illustrated in FIG. 9B. The blade's 320 rotational range is limited so that the blade 320 stops rotating once it is pointing in a parallel direction to the body 302. In an open position, the blade 320 is also generally in the middle of the body 302. In other words, the blade 320 opens to a position as close as possible to the central axis of the radial foldout tool 300. To position the blade 320 in a closed position, the user rotates the blade 320 in an opposite direction from the opening direction so that the blade 320 rests behind the protective covering 318, particularly between the protective covering 318 and the body 302 of the radial foldout tool 300.

In some embodiments, the blade 320 is stainless or a plated steel. In some embodiments, the blade 320 is rust-proof. In other embodiments, the blade 320 is coupled to a spring mechanism (not illustrated) to facilitate the opening and closing of the blade 320. In other embodiments, the radial foldout tool 300 has a locking mechanism (not illustrated) such that the blade 320 locks in place in a closed and/or open position to prevent injuries during use and/or non-use.

Figure 8D:
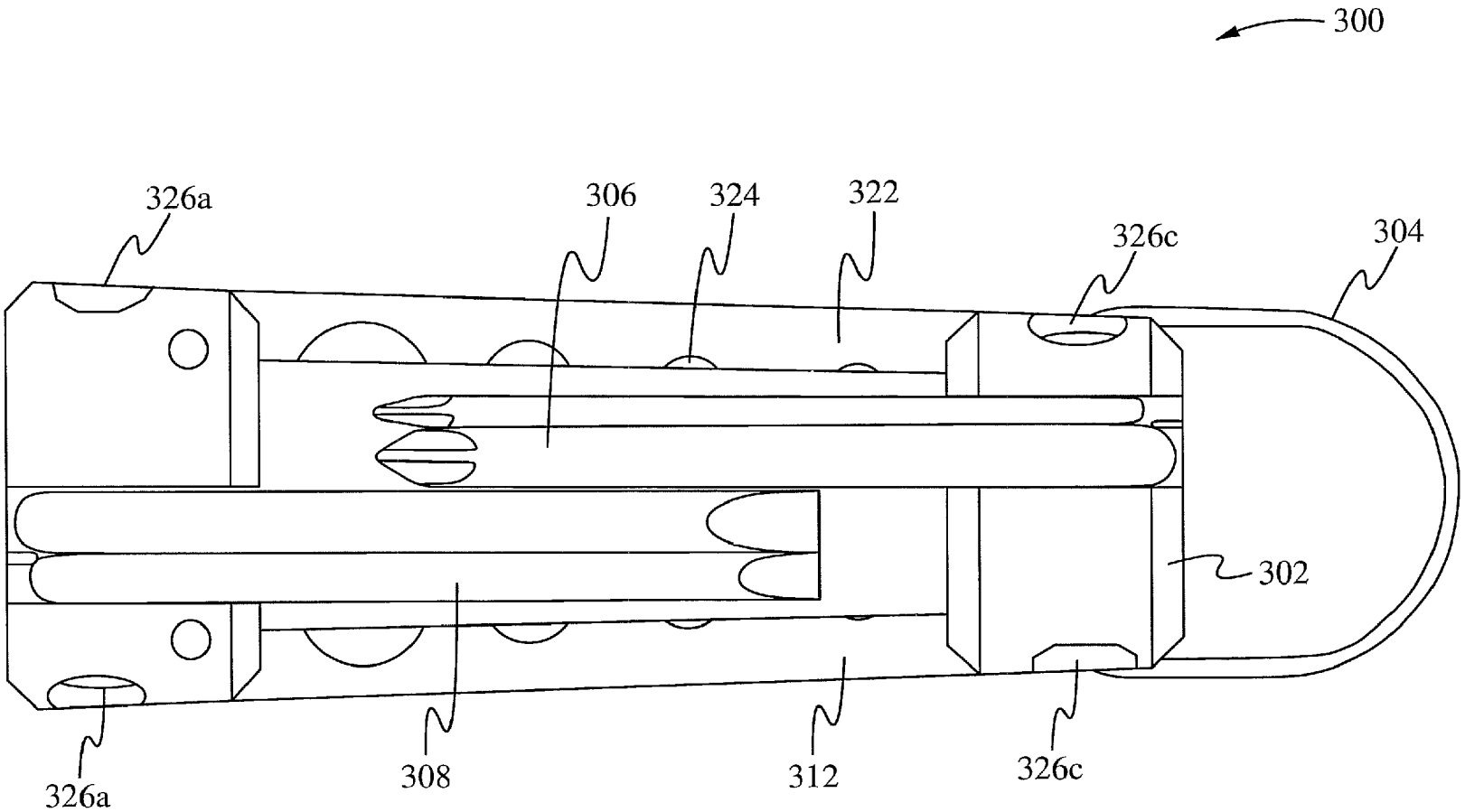
FIG. 8D illustrates an isometric view of a radial foldout tool in a closed position in accordance with the present invention.

In some embodiments, the radial foldout tool 300 typically has at least one set of tool drivers. FIG. 8D illustrates an isometric view of a fourth face of the radial foldout tool 300. As illustrated in FIG. 8D, the radial foldout tool 300 has two sets of tool drivers. The first set of tool drivers 308 is coupled to the bottom end of the radial foldout tool 300. The second set of tool drivers 306 is coupled to the top end of the radial foldout tool 300. To use a tool driver, the user rotates the tool driver out and away from the body 302. In some embodiments, a hard stop prevents the tool driver from opening past a certain angle such as 180° so that when the tool driver stops rotating, the tool driver is pointing in a parallel direction to the body 302. To position the tool driver in a closed position, the user rotates the tool driver in an opposite direction from the opening direction.

In some embodiments, the first set of tool drivers 308 rotates about a rotatable mechanism, such as a screw 326*a*, within the bottom end of the radial foldout tool 300 to an open position. In some embodiments, the second set of tool drivers 306 rotates about a rotatable mechanism, such as a screw 326*c*, within the top end of the radial foldout tool 300 to an open position. In some embodiments, a hard stop prevents the tool driver from opening past a certain angle such as 180° so that when the tool driver stops rotating, the tool driver is pointing in a parallel direction to the body 302. To position the tool driver in a closed position, the user rotates the tool driver in an opposite direction from the opening direction.

The tool drivers are configured to tighten or loosen an object such as a screw or bolt. As illustrated in FIG. 8D, the first set of tool drivers 308 comprises flat head screwdrivers, and the second set of tool drivers 306 comprises phillips head screwdrivers. In some embodiments, the flat head screwdrivers include a 3/16 inch flat head screwdriver and a ¼ inch flat head screwdriver. In some embodiments, the phillips head screwdrivers include a #1 (e.g., small-sized) phillips head screwdriver and a #2 (e.g., medium-sized) phillips head screwdriver. While an example of the radial foldout tool 300 with flat head screwdrivers and phillips head screwdrivers has been shown, other types and/or combinations of tool drivers are possible, such as Pozi-drive screwdrivers, Roberts screwdrivers, Torxhexagonal screwdrivers, hexagonal wrenches, star-shaped drivers, and other suitable tools.

In some embodiments, each tool driver of the first set of tool drivers 308 is coupled to the bottom end of the radial foldout tool 300 in a predetermined order such as size. Similarly, in some embodiments, each tool driver of the second set of tool drivers 306 is coupled to the top end of the radial foldout tool 300 in a predetermined order such as size. For example, a largest tool driver is positioned nearest to a middle or center of the radial foldout tool 300. As such, in an open position, the largest tool driver is generally in the middle of the body 302. In other words, the largest tool folds out to a position as close as possible to the central axis of the radial foldout tool 300. Having the largest tool driver generally in the middle of the body 302 advantageously provides a more even torque during usage. Alternatively, the smallest tool driver of the first set of tool drivers 308 is positioned towards the middle of the radial foldout tool 300. Alternatively, the smallest tool driver of the second set of tool drivers 306 is positioned towards the middle of the radial foldout tool 300.

Figure 8E:
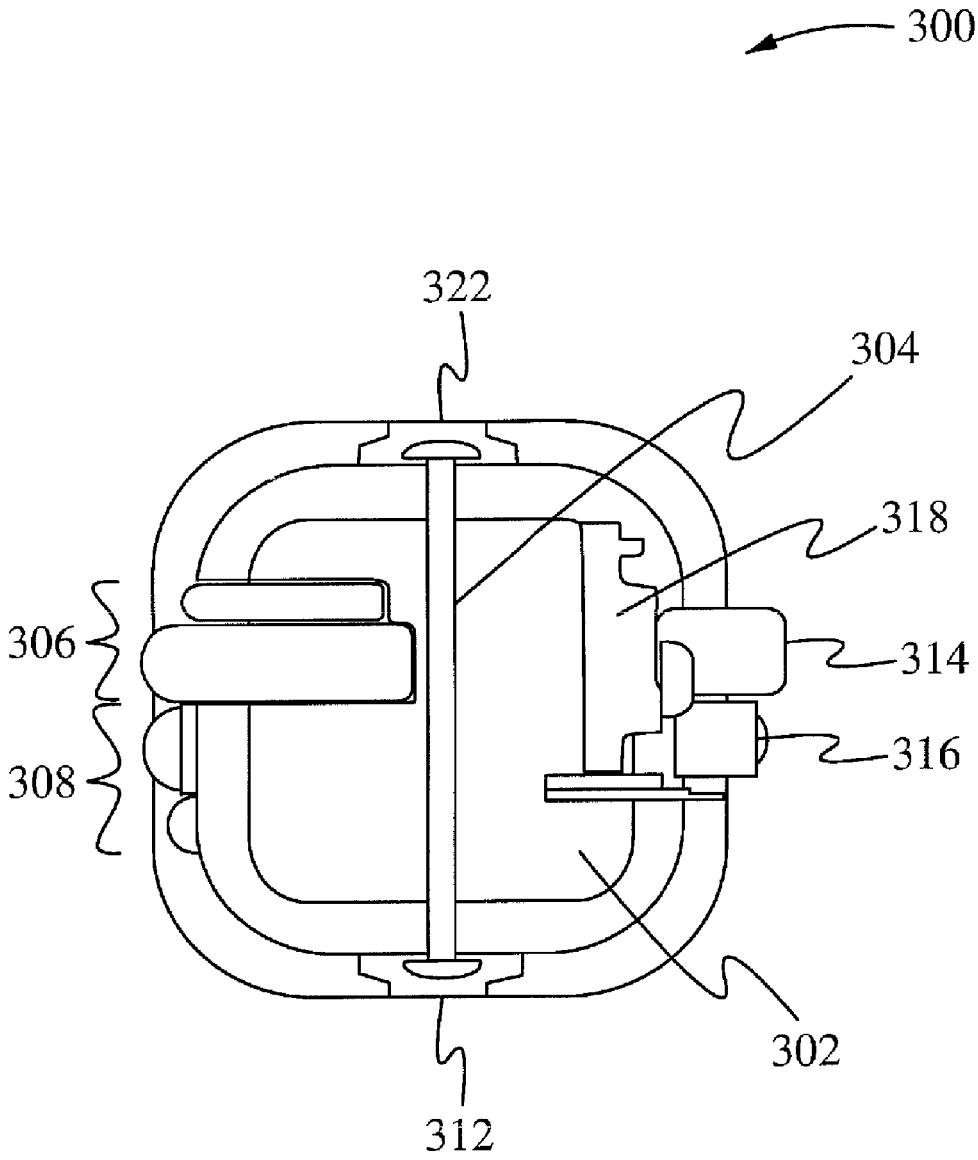
FIG. 8E illustrates an isometric view of a radial foldout tool in a closed position in accordance with the present invention.

FIG. 8E illustrates an isometric top view of the radial foldout tool 300. From the top, certain aspects of the radial foldout tool 300 are visible, such as the bent loop 304, the first bit holder 312, the second bit holder 322, the drive 316, the bottle opener 314, the protective covering 318 for the blade 320, the first set of tool drivers 308, and the second set of tool drivers 306. As described above, the radial foldout tool 300 has four sides; yet, the body 302 is generally cylindrical in shape and surface. In some embodiments, the top end has the dimensions of approximately 1.47"×1.35". In some embodiments, the bottom end is bigger than the top end because bigger sockets are positioned towards the bottom end of the radial foldout tool 300 and smaller sockets are positioned towards the top end of the radial foldout tool 300. As such, the bottom end is wider than the top end. In some embodiments, the bottom end has a flat surface such that the radial foldout tool 300 is able to stand upright on the bottom end.

Figure 9A:
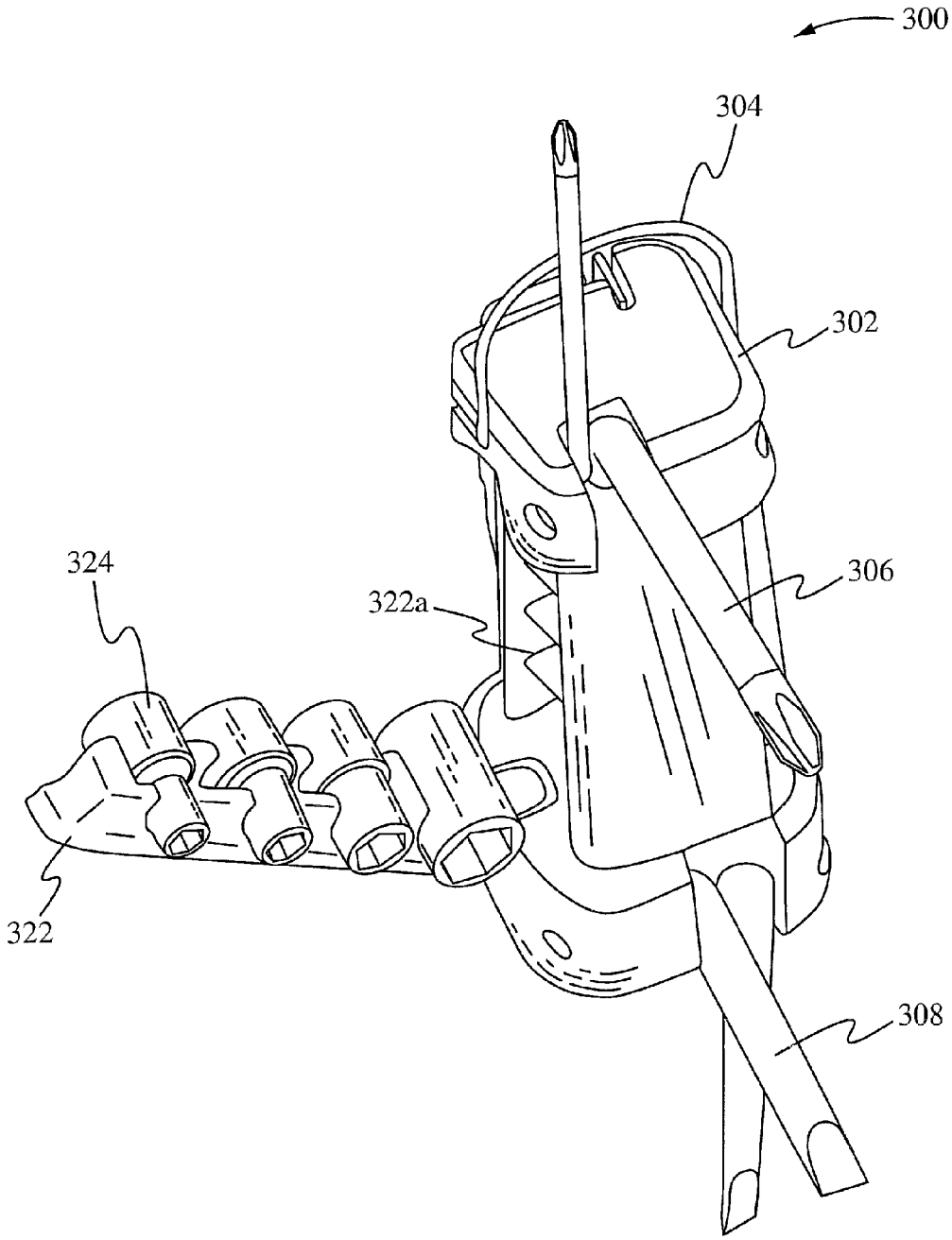
FIG. 9A illustrates a perspective view of a radial foldout tool in an open or partially open position in accordance with the present invention.
Figure 9B:
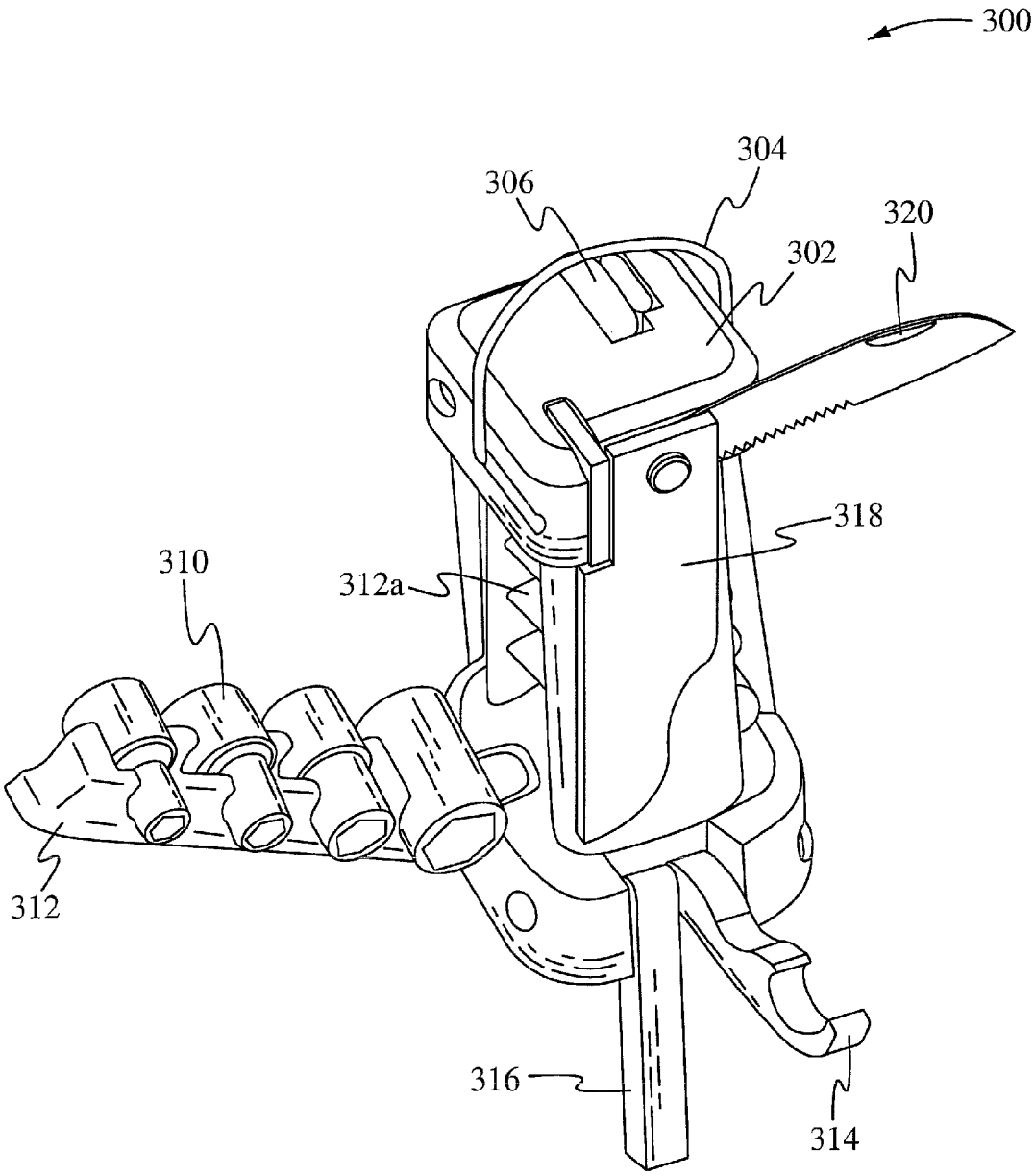
FIG. 9B illustrates a perspective view of a radial foldout tool in an open or partially open position in accordance with the present invention.

FIG. 9A illustrates a perspective view of the radial foldout tool 300 in an open or partially open position in accordance with the present invention. Specifically, FIG. 9A shows tools coupled to the third face and the fourth face of the radial foldout tool 300 in an open or partially open position. The drawing of FIG. 9A is for illustration only. When in use, the radial foldout tool 300 is designed to work with one tool open at a time.

As illustrated in FIG. 9A, the second bit holder 322 has a plurality of beds or chambers. Each bed is sized and configured to hold in place a metric size hex socket 324. In some embodiments, the metric size hex sockets 324 are positioned within the beds in a predetermined order such as size or type. Typically, the third face of the body 302 has corresponding grooves 322*a* sized and adapted to fit the metric size hex sockets 324 in a closed position. To position the second bit holder 322 in the closed position, the user rotates the second bit holder 322 in an opposite direction from the opening direction. In the closed position, the second bit holder 322 locks in place and secures the metric size hex sockets 324 against the body 302.

FIG. 9B illustrates a perspective view of the radial foldout tool 300 in an open or partially position in accordance with the present invention. Specifically, FIG. 9B shows tools coupled to the first face and the second face of the radial foldout tool 300 in an open or partially open position. The drawing of FIG. 9B is for illustration only. When in use, the radial foldout tool 300 is designed to work with one tool open at a time.

As illustrated in FIG. 9B, the first bit holder 312 has a plurality of beds or chambers. Each bed is sized and configured to hold in place a standard size hex socket 310. In some embodiments, the standard size hex sockets 310 are positioned within the beds in a predetermined order such as size or type. Typically, the first face of the body 302 has corresponding grooves 312*a* sized and adapted to fit the standard size hex sockets 310 in a closed position. To position the first bit holder 312 in the closed position, the user rotates the first bit holder 312 in an opposite direction from the opening direction. In the closed position, the first bit holder 312 locks in place and secures the standard size hex sockets 310 against the body 302.

In some embodiments, the body 302 is widest at each end when the radial foldout tool 300 is in an open or partially open position.

Figure 10:
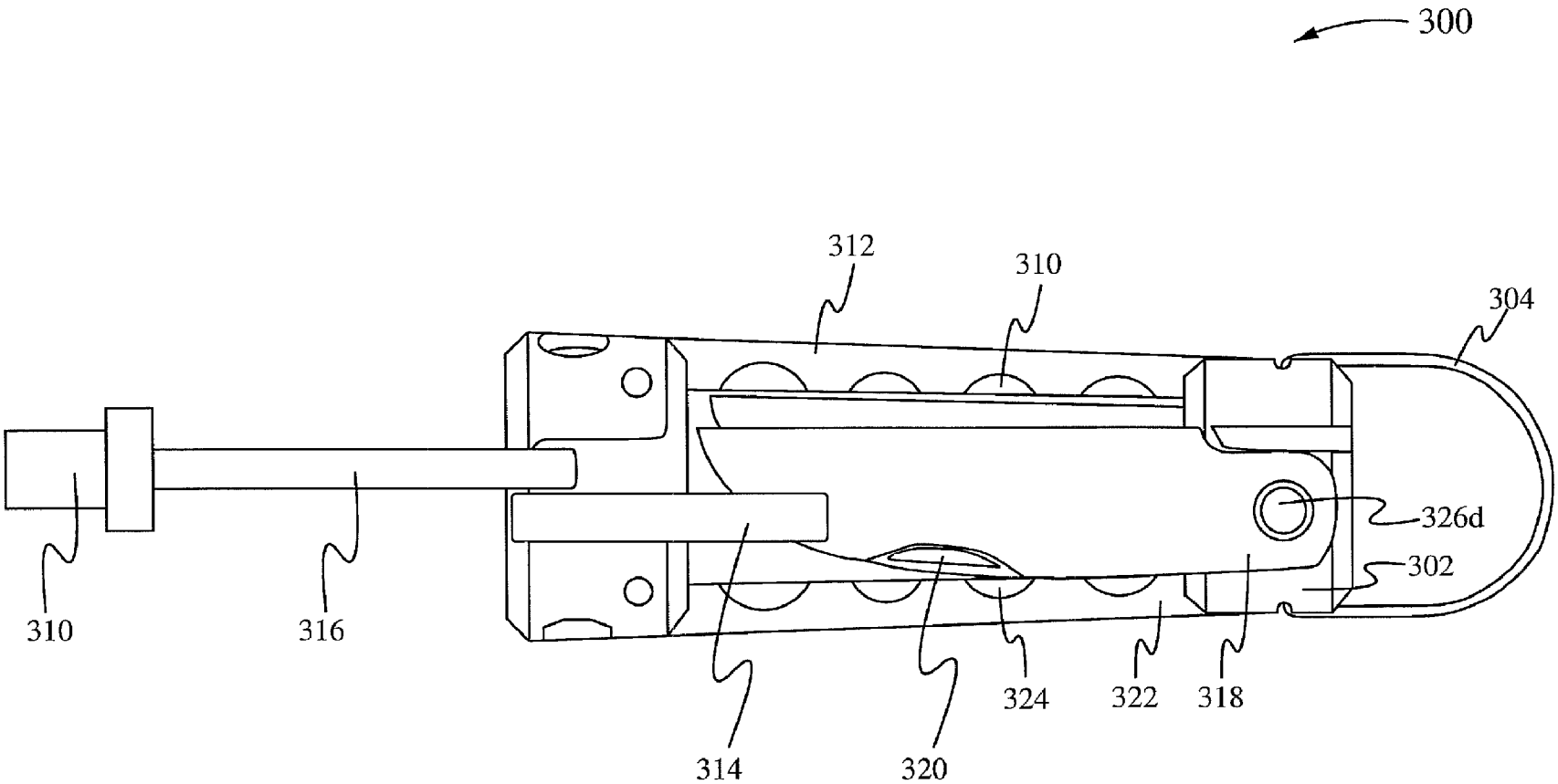
FIG. 10 illustrates an isometric view of a radial foldout tool with a drive in an open position and coupled to a socket in accordance with the present invention.

In operation, the radial foldout tool 300 contains multiple tools to consolidate the space needed for multiple tools. Furthermore, the body 302 of the radial foldout tool 300 has a plurality of faces for storing the tools in a closed position. To utilize a socket, a user removes the socket from the first bit holder 312 or the second bit holder 322 by rotating the holder away from the body 302 of the radial foldout tool 300 in an open position. After removing the socket, the user rotates the holder back towards the body 302 of the radial foldout tool 300 into a closed position. Next, the user rotates the drive 316 into an open position and couples the selected socket to an end of the drive 316. The user then grasps the body 302 of the radial foldout tool 300 similarly to grasping a handle of a screwdriver. The user turns the body 302 of the radial foldout tool 300 to either tighten or loosen an object. FIG. 10 illustrates an isometric view of the radial foldout tool 300 with the drive 316 in an open position and coupled to a socket.

To utilize the bottle opener 314, the user rotates the bottle opener 314 from a closed position to an open position parallel to the body 302 of the radial foldout tool 300. Similarly, to utilize a tool driver, the user rotates the tool driver from a closed position to an open position parallel to the body 302 of the radial foldout tool 300. To utilize the blade 320, the user rotates the blade 320 to a side until the blade 320 is pointing in a parallel direction to the body 302 of the radial foldout tool 300.

In some embodiments, the tools are locked in the closed position. When in the closed position, the tools are safely stored against the body 302 of the radial foldout tool 300 to prevent injuries. Unlike a standard screwdriver which has a sharp point jutting out of the handle, the radial foldout tool 300 is able to be compacted and stored safely. In some embodiments, with the tools locked in the closed position, the radial foldout tool 300 is able to stand upright on the bottom end of the radial foldout tool 300. In other embodiments, the radial foldout tool 300 is also able to stand upright on the top end of the radial foldout tool 300.

Composition of the Body

A body of a radial foldout tool is able to be composed of any appropriate material, which is of maximum strength and includes properties which resist materials that the handle will likely be exposed to, e.g., oil, grease, gasoline and the like. In some embodiments, the body is materially composed of 30% glass-filled polypropylene or nylon. In some embodiments, the body is materially composed of any suitable composition including, but not limited to aluminum or steel or thermoplastic rubber. In some embodiments, the radial foldout tool has a re-enforced polypropylene body. In some embodiments, tools are materially composed of aluminum, steel or any other appropriate material. In some embodiments, the body is constructed using an injection molded, core/cavity process as is well known in the art. Alternatively, the body may be constructed in any known manner.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the appended claims.

What is claimed is:

1. A folding multi-tool comprising:

a. a body comprising a first face, a second face, a third face and a fourth face, a top end and a bottom end of the body, wherein the top end and the bottom end are positioned on opposite ends of the body;

b. a plurality of tools stored against the first face in a closed position;

c. a first socket holder configured to secure a first set of sockets within the second face of the body; and d. a second socket holder configured to secure a second set of sockets within the third face of the body.

2. The folding multi-tool of claim 1 wherein the first socket holder and the second socket holder comprise a plurality of beds, wherein each bed is sized and configured to hold in place a socket.

3. The folding multi-tool of claim 2 wherein the socket is a metric size socket or a standard size socket.

4. The folding multi-tool of claim 1 wherein the plurality of tools includes a set of tool drivers, wherein each tool driver of the set is configured to rotate about a rotatable mechanism coupled to the bottom end of the body.

5. The folding multi-tool of claim 4 wherein each tool driver is arranged according to size, wherein a biggest tool driver is positioned generally near a middle of the body.

6. The folding multi-tool of claim 1 wherein the plurality of tools includes a set of tool drivers, wherein each tool driver of the set is configured to rotate about a rotatable mechanism coupled to the top end of the body.

7. The folding multi-tool of claim 6 wherein each tool driver is arranged according to size, wherein a biggest tool driver is positioned generally near a middle of the body.

8. The folding multi-tool of claim 1 wherein the plurality of tools includes a drive, wherein the drive is configured to rotate about a rotatable mechanism coupled to the bottom end of the body, and wherein the drive is adapted to fit a socket.

9. The folding multi-tool of claim 8 wherein the drive is positioned generally near a middle of the body.

10. The folding multi-tool of claim 1 wherein the plurality of tools includes a can opener, wherein the can opener is configured to rotate about a rotatable mechanism coupled to the bottom end of the body.

11. The folding multi-tool of claim 10 wherein the can opener is positioned generally near a middle of the body.

12. The folding multi-tool of claim 1 wherein the plurality of tools includes a blade, wherein the blade is configured to rotate about an insert coupled to the top end of the body.

13. The folding multi-tool of claim 1 further comprising a bent loop coupled to top end of the body, wherein the bent loop is configured to attach the folding multi-tool to objects.

14. The folding multi-tool of claim 1 wherein the folding multi-tool is configured to stand upright on the bottom end.

15. The folding multi-tool of claim 1, wherein the first socket holder is configured to rotate about a first hinge coupled to the bottom end of the body, and the second socket holder is configured to rotate about a second hinge coupled to the bottom end of the body.

16. A foldout tool comprising:

a. a body comprising:

i. a plurality of faces;

ii. a top end of the body; and iii. a bottom end of the body, wherein the top end and the bottom end are positioned on opposite ends of the body;

b. a first socket storage coupled to a first face of the plurality of faces, wherein the first socket storage rotates about a first rotatable mechanism coupled to the bottom end of the body;

c. a second socket storage coupled to a second face of the plurality of faces, wherein the second socket storage rotates about a second rotatable mechanism coupled to the bottom end of the body; and d. a drive coupled to a third face of the plurality of faces, wherein the drive rotates about a third rotatable mechanism coupled to the bottom end of the body, and wherein the drive is adapted to fit a socket.

17. The foldout tool of claim 16 wherein the first socket storage and the second socket storage comprise a plurality of chambers sized and configured to hold in place a plurality of sockets.

18. The foldout tool of claim 16 wherein the socket is a metric size socket or a standard size socket.

19. The foldout tool of claim 16 further comprising a can opener coupled to the third face, wherein the can opener rotates about the third rotatable mechanism.

20. The foldout tool of claim 16 further comprising a first set of tool drivers and a second set of tool drivers coupled to a fourth face, wherein each tool driver of the first set rotates about a fourth rotatable mechanism coupled to the bottom end of the body, and wherein each tool driver of the second set rotates about a fifth rotatable mechanism coupled to the top end of the body.

21. The foldout tool of claim 16 further comprising a blade, wherein the blade is configured to rotate about an insert coupled to the top end of the body.

22. The foldout tool of claim 16 further comprising a bent loop coupled to top end of the body, wherein the bent loop is configured to attach the foldout tool to objects.

23. The foldout tool of claim 16 wherein the foldout tool is configured to stand upright on the bottom end of the foldout tool.

24. An apparatus comprising a body having a first end, a second end, and four faces, wherein each face has a plurality of tools, wherein each of the plurality of tools is positioned generally near a middle of the body and rotates out from the face, and wherein the apparatus is configured to stand upright on the second end.

25. The apparatus of claim 24 wherein the four faces include a first face, wherein the first face comprises a bit storage and a hinge, wherein the bit storage holds at least one socket and rotates about the hinge, wherein the hinge is coupled to the second end of the body.

26. The apparatus of claim 24 wherein the four faces includes a second face, wherein the second face comprises a bit storage and a hinge, wherein the bit storage holds at least one socket and rotates about the hinge coupled to the second end of the body.

27. The apparatus of claim 24 wherein the four faces includes a third face, wherein the third face comprises a drive, a can opener, and a blade, wherein the drive and the can opener rotate about a rotatable mechanism coupled to the second end of the body, and the blade rotates about an insert coupled to the first end of the body.

28. The apparatus of claim 24 wherein the four faces includes a fourth face, wherein the fourth face comprises a first set of tool drivers and a second set of tool drivers, wherein each tool driver of the first set rotates about a first pivotable mechanism coupled to the second end of the body, and wherein each tool driver of the second set rotates about a second pivotable mechanism coupled to the first end of the body.

29. A tool handle comprising:

a. a body comprising:

i. a first face of the body;

ii. a second face of the body;

iii. a third face of the body, wherein the third face is opposite the first face;

iv. a fourth face of the body, wherein the fourth face is opposite the second face;

v. a top end of the body; and vi. a bottom end of the body, wherein the top end and the bottom end are positioned on opposite ends of the body;

b. a plurality of tools comprising:

i. a bent loop coupled to top end of the body, wherein the bent wire loop is configured to attach the tool handle to objects;

ii. a first depository comprising a first plurality of chambers sized and configured to hold in place metric size sockets, wherein the first depository is coupled to the first face, and wherein the first depository rotates about a first rotatable mechanism coupled to the bottom end of the body;

iii. a second depository comprising a second plurality of chambers sized and configured to hold in place standard size sockets, wherein the second depository is coupled to the third face, and wherein the second depository rotates about a second rotatable mechanism coupled to the bottom end of the body;

iv. a drive coupled to the second face, wherein the drive rotates about a third rotatable mechanism coupled to the bottom end of the body, and wherein the drive is adapted to fit ends of the metric size sockets and ends of the standard size sockets;

v. a can opener coupled to the second face, wherein the can opener rotates about the third rotatable mechanism;

vi. a blade coupled to the second face, wherein the blade is configured to rotate about a fourth rotatable mechanism coupled to the top end of the body;

vii. a first set of tool drivers coupled to the fourth face, wherein each tool driver of the first set rotates about a fifth rotatable mechanism coupled to the bottom end of the body; and viii. a second set of tool drivers coupled to the fourth face, wherein each tool driver of the second set rotates about a sixth rotatable mechanism coupled to the top end of the body, wherein the tool handle is configured to stand upright on the bottom end of the body.

* * * * *